US011028771B2

(12) United States Patent
Ardezzone

(10) Patent No.: US 11,028,771 B2
(45) Date of Patent: Jun. 8, 2021

(54) MODULAR INTERNAL COMBUSTION ENGINE WITH ADAPTABLE PISTON STROKE

(71) Applicant: Frank J. Ardezzone, Santa Clara, CA (US)

(72) Inventor: Frank J. Ardezzone, Santa Clara, CA (US)

( * ) Notice: Subject to any disclaimer, the term of this patent is extended or adjusted under 35 U.S.C. 154(b) by 0 days.

(21) Appl. No.: 15/595,751

(22) Filed: May 15, 2017

(65) Prior Publication Data

US 2017/0328277 A1 Nov. 16, 2017

Related U.S. Application Data

(60) Provisional application No. 62/336,754, filed on May 16, 2016.

(51) Int. Cl.

| | |
|---|---|
| ***F01B 9/06*** | (2006.01) |
| ***F02B 75/22*** | (2006.01) |
| ***F01B 1/06*** | (2006.01) |
| ***F01B 1/12*** | (2006.01) |
| ***F02B 75/32*** | (2006.01) |
| *F02B 75/24* | (2006.01) |

(52) U.S. Cl.

CPC ..... *F02B 75/222* (2013.01); *F01B 1/0624* (2013.01); *F01B 1/12* (2013.01); *F02B 75/32* (2013.01); *F01B 9/06* (2013.01); *F02B 75/24* (2013.01)

(58) Field of Classification Search

CPC ..... F01B 1/12; F02B 75/222; F02B 75/32
USPC ..... 123/52.4, 53.5, 54.1, 54.2, 54.3, 55.3, 123/55.1

See application file for complete search history.

(56) References Cited

U.S. PATENT DOCUMENTS

| | | | | | |
|---|---|---|---|---|---|
| 1,639,333 | A * | 8/1927 | Ford | F02B 75/222 | 123/54.2 |
| 1,829,780 | A * | 11/1931 | Beytes | F01B 9/06 | 123/323 |
| 2,021,590 | A * | 11/1935 | Coombs | F01L 1/42 | 123/54.2 |
| 2,088,215 | A * | 7/1937 | Podrabsky | F02B 25/00 | 123/54.2 |
| 2,757,547 | A * | 8/1956 | Julin | F01B 9/047 | 123/197.4 |
| 2,962,861 | A * | 12/1960 | Beaven | F02B 75/222 | 123/44 R |
| 3,358,439 | A * | 12/1967 | De Coye De Castelet | F02B 37/00 | 123/213 |
| 3,396,709 | A * | 8/1968 | Robicheaux | F01B 3/0005 | 123/45 R |

(Continued)

FOREIGN PATENT DOCUMENTS

| | | | | |
|---|---|---|---|---|
| DE | 586035 C1 | | 10/1933 | |
| FR | 52921 E | | 8/1945 | |
| GB | 536580 A | * | 5/1941 | F02B 75/222 |

*Primary Examiner* — George C Jin
*Assistant Examiner* — Teuta B Holbrook
(74) *Attorney, Agent, or Firm* — Law Office of Craig Bohn; Craig E. Bohn

(57) ABSTRACT

A modular internal combustion engine (10) comprising a cam crank (74) having a piston stroke guide pattern (76) to control the stroke motion profile of the piston (70), which can be expanded by replacing the crank shaft (22) with a longer crank shaft (22), and installing a supplemental engine block (18) with a supplemental cam crank assembly (75).

14 Claims, 25 Drawing Sheets

(56) References Cited

U.S. PATENT DOCUMENTS 3,605,705 A * 9/1971 Ziegler ..... F01B 1/12 123/192.1
3,701,306 A * 10/1972 Eck ..... F01B 1/0696 91/482
3,776,203 A * 12/1973 Joyce, Sr. ..... F01B 9/026 123/193.3
3,964,450 A * 6/1976 Lockshaw ..... F01B 1/0613 123/190.6
4,078,529 A * 3/1978 Warwick ..... F01B 1/0655 123/44 C
4,127,036 A * 11/1978 Pinto ..... F01B 5/00 123/197.5
4,381,740 A 5/1983 Crocker
4,408,577 A * 10/1983 Killian ..... F01B 1/0603 123/44 E
4,763,619 A * 8/1988 Eitel ..... F02F 1/002 123/193.3
4,848,296 A * 7/1989 Lopez ..... F01C 1/3442 123/242
5,765,512 A * 6/1998 Fraser ..... F01B 1/0603 123/54.1
5,794,573 A * 8/1998 Sunley ..... F01C 9/002 123/18 R
6,062,175 A * 5/2000 Huang ..... F01B 1/12 123/43 R
6,691,648 B2 2/2004 Beierle
7,121,252 B2 10/2006 Johnson
7,137,365 B2 11/2006 Maslen
7,219,631 B1 5/2007 O'Neill
8,151,759 B2 * 4/2012 Wright ..... F01C 3/02 123/206
8,336,518 B2 * 12/2012 Sleiman ..... F01C 1/3446 123/243
2002/0017264 A1 * 2/2002 Pong ..... F02B 75/32 123/193.4
2002/0070692 A1 * 6/2002 Gonzales ..... B60L 50/15 318/34
2005/0155561 A1 * 7/2005 Atkins ..... F01P 3/02 123/41.81
2005/0172918 A1 8/2005 Humphries
2007/0108851 A1 * 5/2007 Hashiba ..... H02K 1/2786 310/58
2011/0180050 A1 * 7/2011 Terry ..... F01B 9/06 123/572
2014/0318483 A1 10/2014 Shutlar

* cited by examiner

MODULAR INTERNAL COMBUSTION ENGINE WITH ADAPTABLE PISTON STROKE

CROSS-REFERENCE TO RELATED APPLICATIONS

This application claims the benefit of U.S. Application No. 62/336,754, filed on May 16, 2016, by the present inventor, entitled "Modular Internal Combustion Engine with Adaptable Piston Stroke," which is hereby incorporated by reference in its entirety for all allowable purposes, including the incorporation and preservation of any and all rights to patentable subject matter of the inventor, such as features, elements, processes and process steps, and improvements that may supplement or relate to the subject matter described herein.

STATEMENT REGARDING FEDERALLY SPONSORED RESEARCH OR DEVELOPMENT

Not Applicable

BACKGROUND OF THE INVENTION

This invention relates generally to internal combustion engines, and more specifically to modular internal combustion engines with a controllable piston stroke cycle.

U.S. Pat. No. 6,691,648 issued to Mark Beierle on Feb. 17, 2004, discloses a design for radial cam driven internal combustion engine that has connecting rod guide pins that slide into ends of the connecting rods, allowing the connecting rods to slide freely linearly while applying side loads on the connecting rods to the crankcase. The patent teaches an oval roller cam return track that guides the piston stroke in an attempt to control the shape of the combustion chamber to synchronize with phases of the operation cycle. The system appears to rely on conventional air, fuel, and cooling systems.

U.S. Pat. No. 7,219,631 issued to James O'Neill on May 22, 2007, discloses an internal combustion engine including a plurality of reciprocating pistons disposed about the periphery of a central housing, and a pair of drive cams responsive to the displacement of the pistons for driving one or more output drive shafts. Key to the design are the pair of drive cams that are disposed within a housing chamber and driven in opposite rotational directions co-axially on an output axis in response to the axial reciprocation of the pistons. The system appears to rely on conventional air, fuel, and cooling systems.

U.S. Pat. No. 7,121,252 issued to Michael Johnson on Oct. 17, 2006, discloses an internal combustion engine that replaces the throw journal of a crankshaft with a set of contoured channels that guide the stroke of a piston. The channels define a circle portion with a straight portion in an attempt to create a straight power ramp during the power stroke of each piston that is attached to the output shaft. The system appears to rely on conventional air, fuel, and cooling systems.

U.S. Pat. No. 7,137,365 issued to Maslen on Nov. 21, 2006, discloses a radial engine that includes an engine block having a planar cam plate fixedly mounted on a shaft. A pair of spaced opposed walls extend from the surface of the plate to form a "figure 8." A reciprocatable piston is slidably mounted within a cylinder in the engine block, which piston has a cam follower engaged with the "figure 8" walls, such that reciprocation of the piston rotates the plate and the shaft.

Though the aforementioned patents may attempt to control the stroke pattern of a reciprocating piston of an internal combustion engine, they fail to effectively ameliorate all the forces that may impede the implementation of a cam-driven piston. Additionally, none of the systems address the entire internal combustion problem, as that they do not address the design of other systems needed to support internal combustion, such as air, fuel or cooling systems. Further, none of the systems provide for convenient modular expansion of a base block and piston assembly, but instead rely on adding additional pistons around the circumference of the drive cam, which would require total engine remanufacturing. It would be a valuable addition to the art, among other things, to provide a compact, integrated internal combustion engine system, that is modularly expandable by combining similar block and piston assemblies, as desired, after the block and piston assemblies are already manufactured.

SUMMARY OF THE INVENTION

The current invention includes a modular internal combustion engine that may be configured in a variety of manners using modular components. Such an engine may have an engine bank, where the engine bank may have at least a pair of opposed cylinders, a cam crank shaft on which is mounted a drive disk, an intake cam disk and an exhaust cam disk attached perpendicularly to the cam crank shaft, as well as an integrated manifold system for managing the air and fuel flow, as well as the coolant, if necessary. Such an engine may be expanded by combining multiple individual engine banks on a longer cam crank shaft, using the original or modified manifold system. The pairs of opposed cylinders may be arranged radially around the cam crank shaft. An alternate embodiment may include that an engine bank have only a single pair of opposed cylinders, such that the engine may be modularly expanded by adding additional pairs of cylinders in additional engine blocks.

An alternate embodiment may include that an engine bank have only one cylinder, and a flywheel or counter weight to provide inertia at critical transition points in the cylinder's combustion cycle. In such an embodiment, the cam crank shaft may provide sufficient weight to act as a flywheel, and store adequate energy to maintain engine travel between power strokes. The modular nature of the engine allows for a wide variety of configurations that build on the basic concepts.

DESCRIPTION OF THE PREFERRED EMBODIMENT

Figure 1:
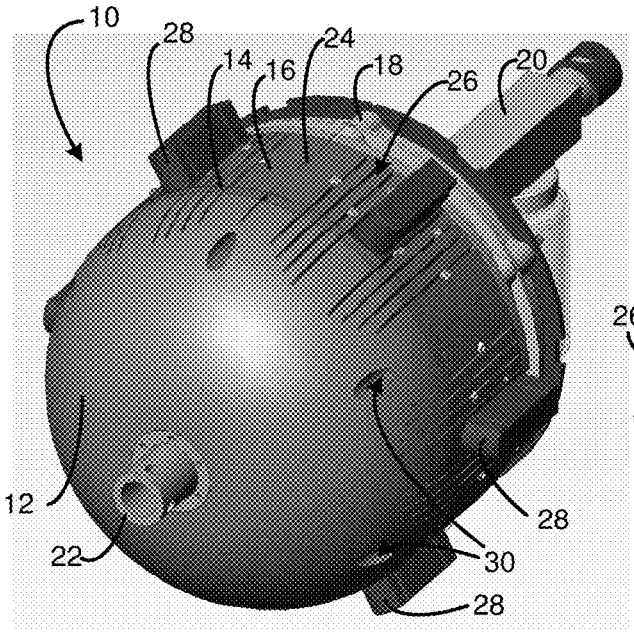
FIG. 1 is an oblique top frontal view an exemplary engine according to the present invention.
Figure 2:
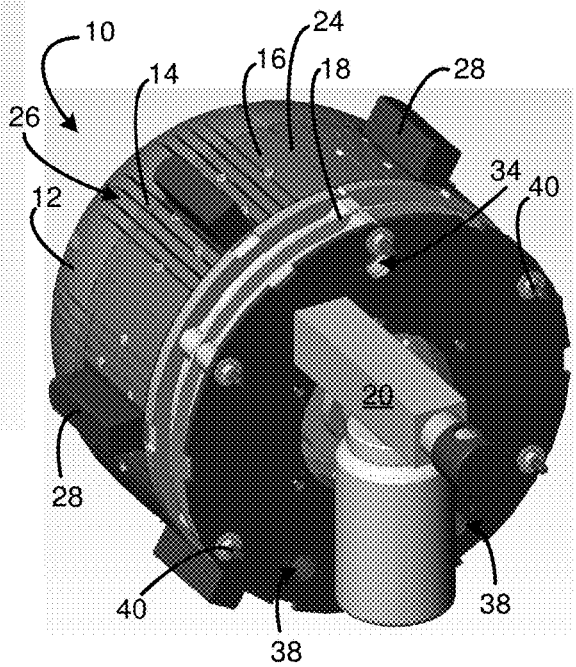
FIG. 2 is an oblique top rear view of the engine in FIG. 1.
Figure 3:
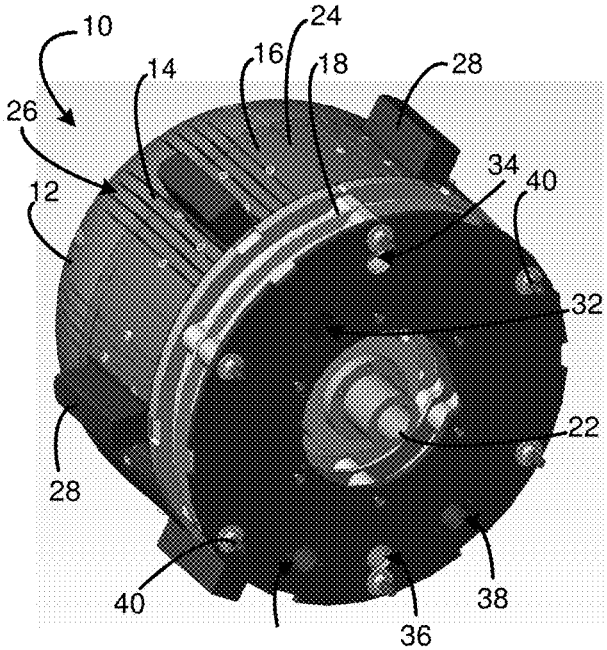
FIG. 3 is an oblique top rear view of the engine in FIG. 1, without a fuel supply subsystem, according to the present invention.

An exemplary internal combustion engine 10 is initially shown in FIGS. 1-3, comprising the components of a bell housing 12, thrust bearing plate 14, an engine block 16, the manifold assembly 18, and a shaft 22. For the convenience of a standard convention, the side of the engine 10 from which the shaft 22 protrudes from the bell housing 12, will be referred to herein as the "front" of the engine, since it is envisioned to be a suitable orientation for use of the engine 10 in an aviation application. As such, the side with the manifold assembly 18 will be referred to herein as the "rear" of the engine.

In the exemplary embodiment, a top groove 24 is provided, which may assist in alignment of the engine 10 components during assembly, and housing grooves 26 may assist in the removal of heat from the engine 10. When referring to the engine 10 as a whole or substantial whole, the "top" will refer to the side with the top groove 24. As will be seen in the future drawings, both the top groove 24 and the housing grooves 26 may be embodied in the peripheral surface of the individual sections, including the bell housing 12, thrust bearing plate 14, engine block 16, and components of the manifold assembly 18. Additionally, the exemplary embodiment may have a plurality of spark plug covers secured to the surface of the engine block 16 to protect the top of the spark plugs (not shown) and ignition wiring (not shown).

In the exemplary embodiment, an exemplary vaporator 20 is shown as an air-fuel mixture delivery system mountable to the rear of the manifold assembly 18, at a fuel mixture intake orifice 32. It is envisioned that the engine 10 may also have the capacity to use a conventional air-fuel mixture delivery system (not shown), including turbocharged or supercharged versions. In the exemplary embodiment, a plurality of assembly bolt channels 30 are contained within the bell housing 12. Exemplary assembly bolts 40, which may include an assembly washer and nut, may be positioned in the assembly bolt channels 30 to extend through the engine 10 to the rear of the manifold assembly 18. The exemplary assembly bolts 40 may be secured in place to hold the components of the engine 10 together. The rear of the manifold assembly 18 also may have a coolant fill orifice 34, a coolant drain orifice 36, and at least one exhaust orifice 38.

Figure 4:
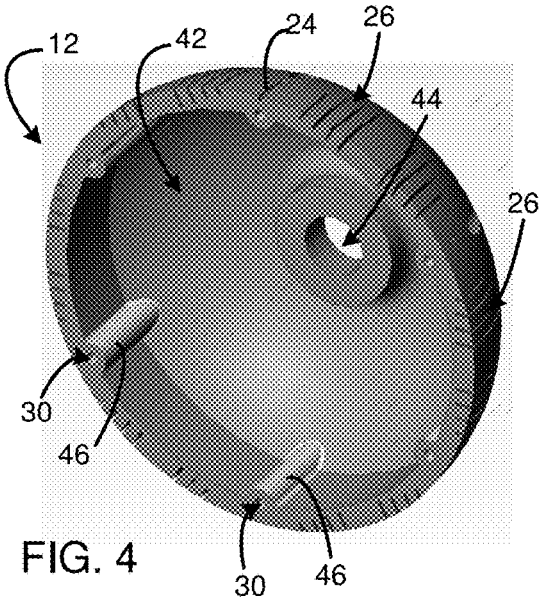
FIG. 4 is an oblique rear view of the bell housing of the engine in FIG. 1.

Referring now also to FIG. 4, an exemplary embodiment of a bell housing 12 is shown from the rear side, exposing the interior bell housing void 42. The bell housing void 42 may provide space for gearing (not shown) on shaft 22, which gearing could facilitate adjustable from shaft 22. In this depiction, a shaft hole 44 is illustrated, through which the shaft 22 may protrude, and in which the shaft 22 may freely rotate. Additionally, a plurality of assembly bolt housings 46, which surround and provide structural support for the assembly bolt channels 30, may also exist.

Figure 5:
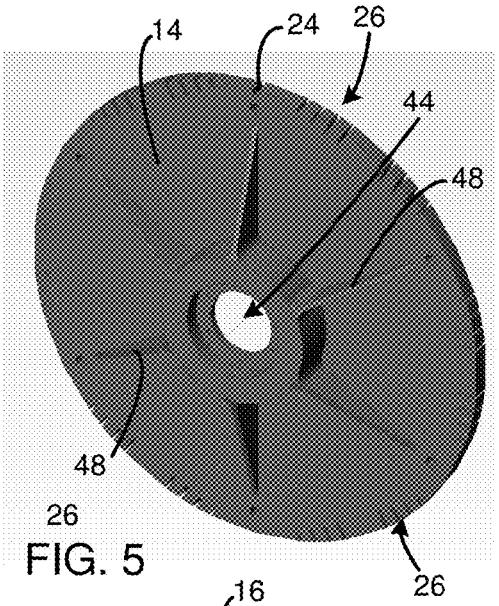
FIG. 5 is an oblique front view of a thrust bearing plate of the engine in FIG. 1.
Figure 6:
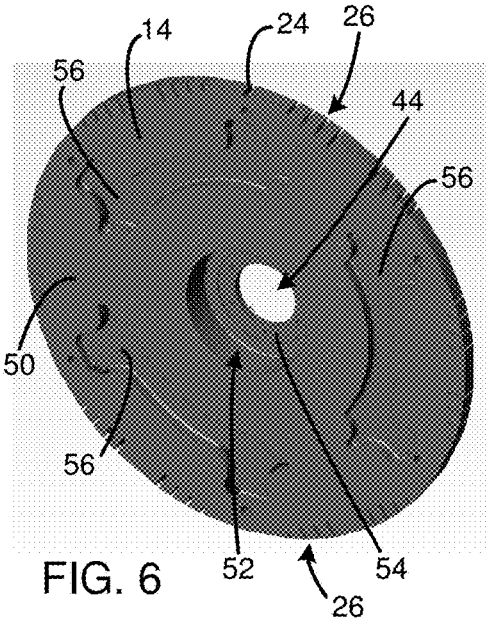
FIG. 6 is an oblique rear view of a thrust bearing plate shown in FIG. 5.

Referring to primarily FIGS. 5 and 6, an exemplary thrust bearing plate 14 is independently displayed to more clearly show the shaft hole 44 and the structure strut supports 48 on the front side of the exemplary thrust bearing plate 14. On the rear side of the thrust bearing plate 14 the engine 10 may have an exemplary engine block contact surface 50, which will snugly secure to the engine block 16. In the exemplary embodiment, a bearing recess 52 is positioned to surround the shaft hole 44. A recess contact face 54 is located within the bearing recess 52, and provides an appropriate surface to contact a bearing positioned on the shaft 22. Additionally, the exemplary engine block contact surface 50 may have a plurality of coolant recesses 56 that provide fluid communication of coolant between sections of a coolant jacket that may be formed within the engine block 16.

Figure 7A:
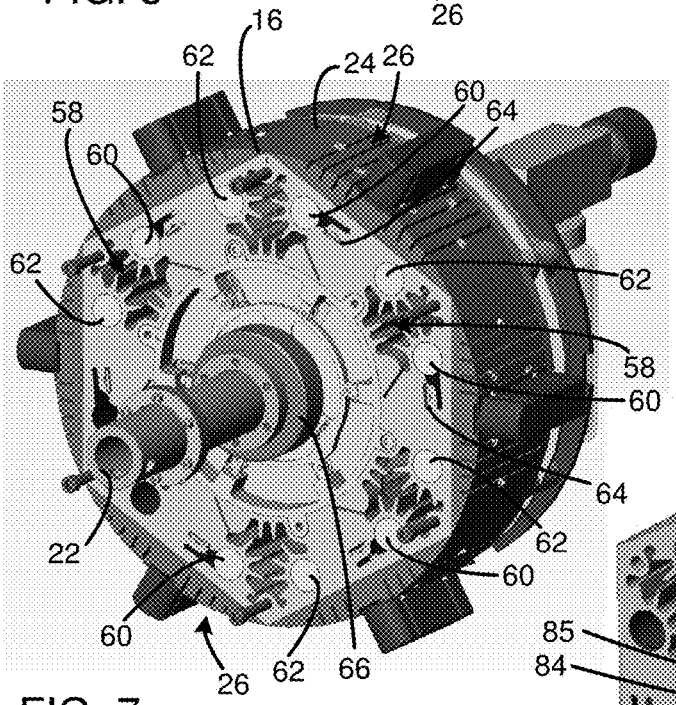
FIG. 7*a* is an oblique front view of the engine block and manifold in FIG. 1 with the bell housing and thrust bearing plate removed.

Referring primarily to FIG. 7*a*, a front side is shown of an exemplary engine block 16. The exemplary engine block 16 may have a flat front side and a flat rear side. The exemplary engine block 16 has a generally cylindrical exterior, because it is a radial design. The current teachings may be adapted for an engine 10 with a rectangular design.

The front side may abut snugly to the engine block contact surface 50 of the thrust bearing plate 14. A snug seal between the engine block 16 and the thrust bearing plate 14 facilitates the retention of pressures and fluids within the engine 10. The exemplary engine block 16 may have a plurality of coolant jacket sections 58 positioned radially around the shaft 22. In the exemplary embodiment, pairs of coolant jacket sections 58 are in fluid communication via a coolant recess 56. In the exemplary embodiment, where the front side of the engine block 16 abuts to the thrust bearing plate 14, intake channel plugs 60 and exhaust channel plugs 62 may be used to seal the respective front ends of intake channels (described and shown below and in later figures) and exhaust channels (described and shown below and in later figures). However, an effective seal against the ending block coolant surface 50 may adequately seal the intake and exhaust channels. The exemplary engine block 16 also may have exemplary valve retainer slots 64, which receive valve assembly retainer clips (described and shown below and in later figures) to secure a valve assembly (described and shown below and in later figures) in the engine block 16. In the exemplary embodiment, a thrust bearing 66 is positioned at the front end of an engine block 16, intermediate the engine block 16 and the thrust bearing plate 14.

Figure 7B:
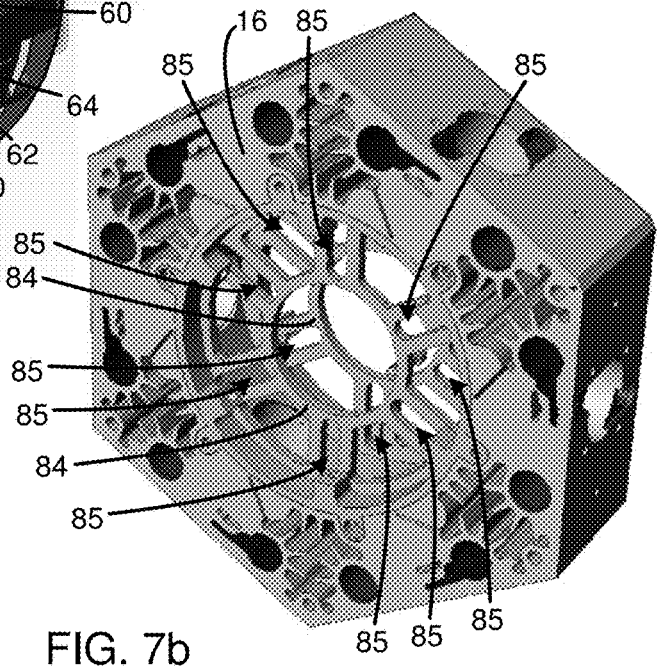
FIG. 7*b* is an oblique front view of alignment plates seated within exemplary engine block for FIG. 7*a*.

Referring now also to FIG. 7*b*, an alternate front view is shown of an exemplary engine block 16 with portions of the engine assembly removed to show exemplary alignment plates 84. The engine block 16 may house an alignment plate 84. Alignment plates 84 may have a plurality of alignment channels 85. In the exemplary embodiment, a pair of alignment plates 84 are positioned parallel to each other, with pairs of their alignment channels 85 radially aligned.

Figure 8A:
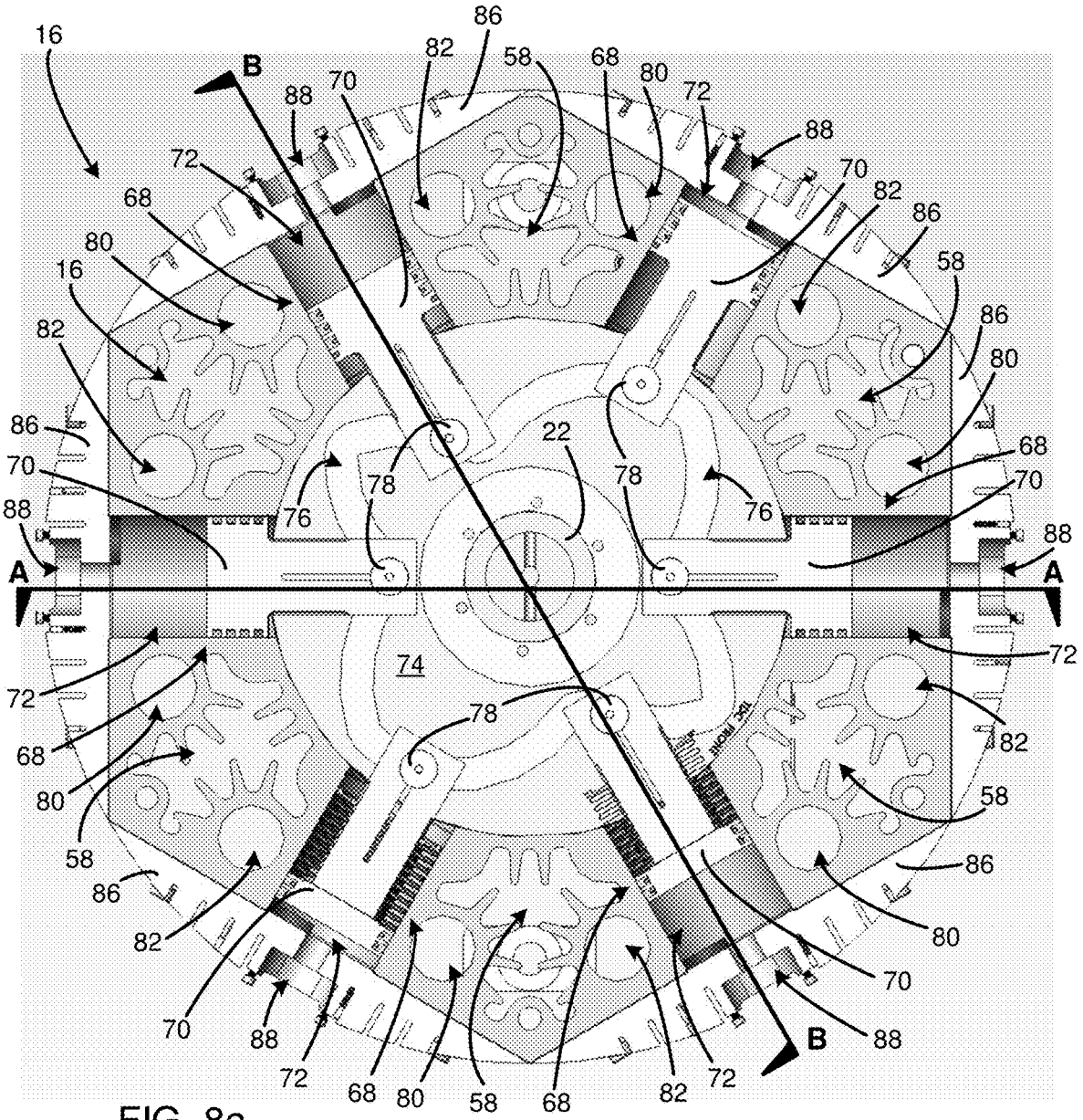
FIG. 8*a* is a normal front view of the engine in FIG. 1, cut so as to show cylinders and pistons of an engine bank.

Referring now also to FIG. 8*a*, an exemplary engine 10 is shown cut perpendicular to the shaft 22 through the exemplary engine block 16 to show the exemplary configuration of the cylinders 68. The exemplary embodiment houses six cylinders 68, but the concept may accommodate fewer or more cylinders 68 in each engine block 16. Each exemplary cylinder comprises a piston assembly 70 positioned to slide linearly within a combustion chamber 72. It is envisioned that an engine block 16 may have a single cylinder 68, if the piston assembly 70 is appropriately counter-weighted.

The exemplary pistons are arranged around a cam crank 74. The cam crank 74 may have a precisely patterned piston crank groove 76 formed into a surface of the cam crank 74. In the exemplary embodiment, corresponding piston crank grooves 76 are positioned on each side of the cam crank 76. A piston traveler 78 is connected to the piston, and positioned in a piston crank groove 76. The precise pattern of the piston crank groove 76 communicates a desired piston assembly 70 position within the combustion chamber 72 through the piston traveler 78. When the piston moves toward the shaft 22, the piston traveler 78 pushes on the cam crank 74 to slide along the piston crank groove 76, forcing the cam crank 74 and the attached shaft 22 to rotate about the axis of the shaft 22.

An alignment plate 84 may provide support against forces that may push on a piston assembly 70 outwardly of a desired position within the cylinder 68. In the exemplary embodiment, alignment plates 84 may be positioned on opposite sides of the cylinders 68. A piston assembly 70 may have additional piston travelers 78 position so as to occupy alignment channels 85 in piston guide plates 84. In the exemplary embodiment, exemplary alignment channels 85 may be radially aligned with a respective cylinder 68, as well as a respective piston assembly 70. In the exemplary embodiment, the alignment plate 84 may be parallel to the cam crank 74. In the exemplary embodiment, alignment channel 85 may restrict the movement of the piston assembly 70 to stay within the cylinder 68, while the piston crank groove 76 of the cam crank 74 forces the piston assembly 70 to move outwardly and inwardly with respect to the shaft 22. The combination of the alignment channels 85 and the piston crank groove 76 result in defining a stroke pattern of piston assembly 70 within a respective cylinder 68.

Fuel mixture may be channeled to a combustion chamber 72 via a respective intake channel 80. Similarly, the exhaust created by combustion may be channeled out of the combustion chamber 72 via a respective exhaust channel 82. Each intake channel 80 is in fluid communication with the fuel mixture intake orifice 32 and a respective combustion chamber 72. Similarly, each exhaust channel 82 is in fluid communication with a respective combustion chamber 72 and an exhaust orifice 38.

At the top of each cylinder 68 may be a cylinder head 86, which can be removed to access a respective piston assembly 70 and combustion chamber 72. Each cylinder head 86 may have a spark plug well 88 formed there through, to receive and hold in position an appropriate sparkplug (not shown) so as to be able to provide an igniting spark within the combustion chamber 72.

Figure 8B:
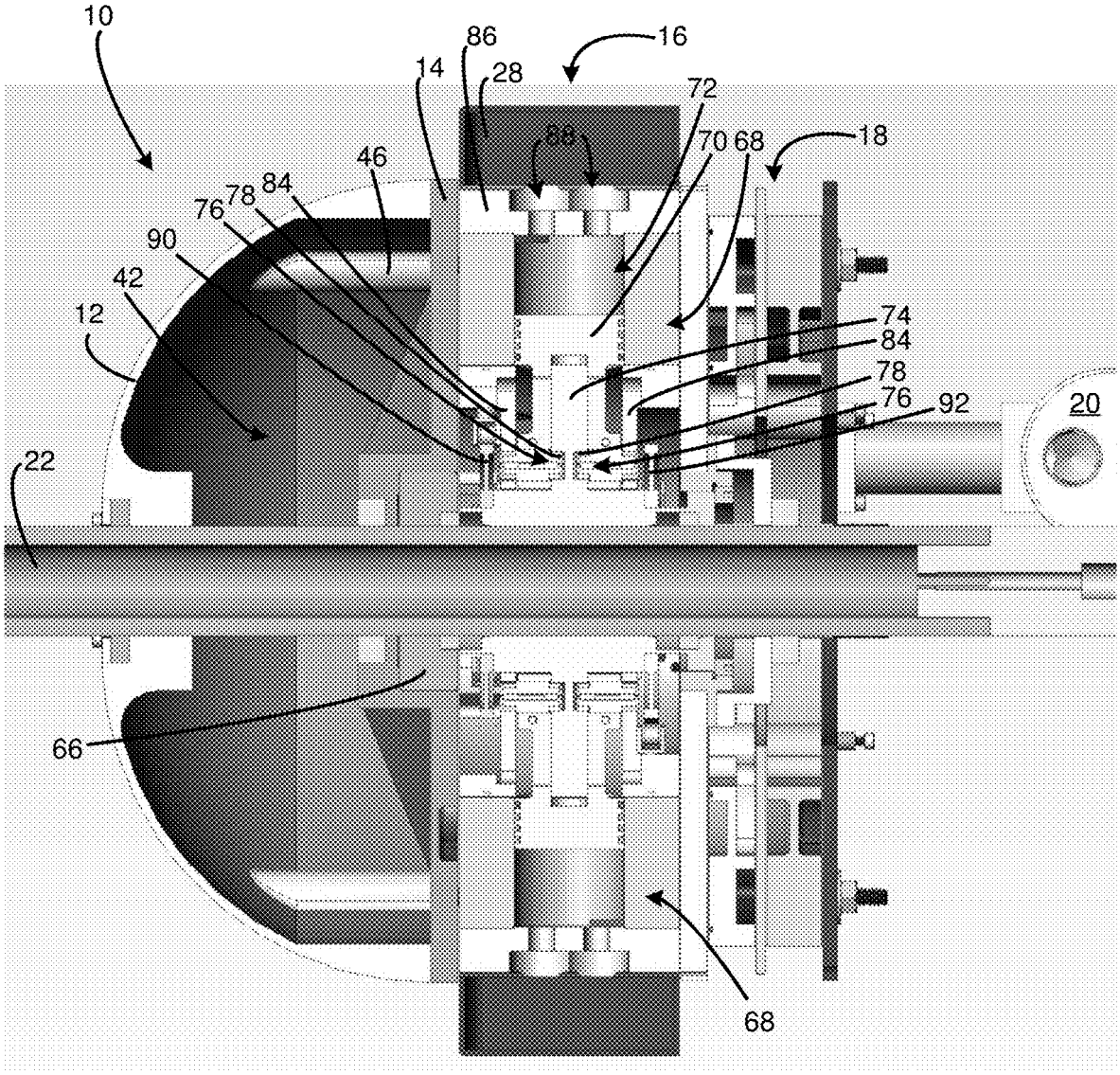
FIG. 8*b* is a side view of the engine shown in FIG. 8*a*, cut at the line A-A.

Referring now also to FIG. 8*b*, an exemplary engine 10 is shown cut through middle along the shaft 22, so as to show another angle of the internal features of the components. A bell housing void 42 is seen within the bell housing 12. Additionally, at least one assembly bolt housing 46 is shown, which houses the assembly bolt channels 30 through the bell housing 12. The exemplary engine block 16 is cut through a pair of opposing cylinders 68 to show a piston assembly 70, combustion chamber 72, piston traveler 78, cylinder head 86, and an exemplary pair of spark plug wells 88 for each cylinder 68. Additionally, the illustration shows a cam crank 74 on shaft 22, in which is formed a piston crank groove 76. Similarly positioned on the shaft 22 as the cam crank 74 is an exemplary intake cam 90 toward the front of engine 10 from the cam crank 74, and an exemplary exhaust cam 92 toward the rear of the engine 10 from the cam crank 74.

Figure 8C:
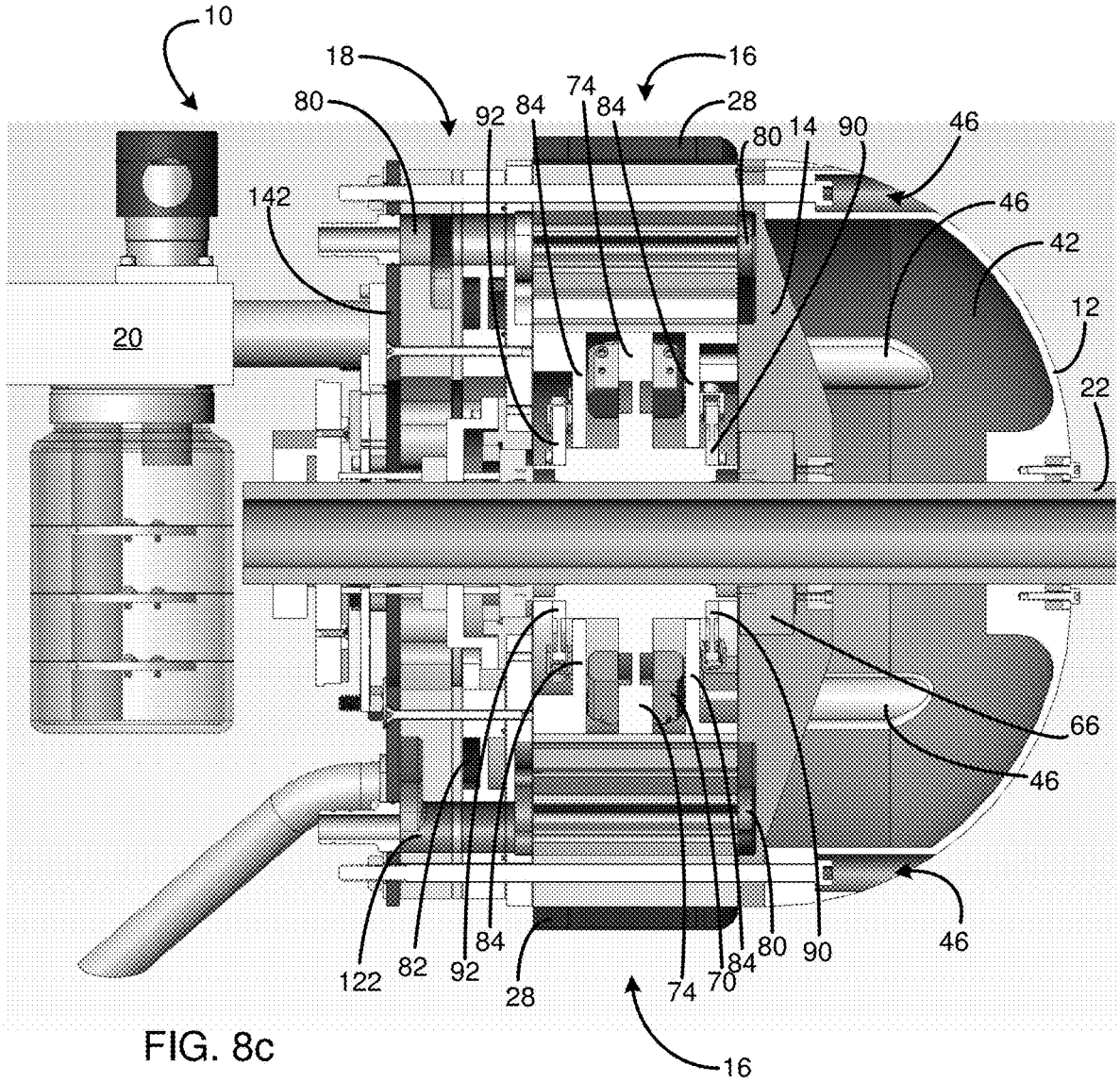
FIG. 8*c* is a side view of the engine shown in FIG. 8*a*, cut at the line B-B.

Referring now also to FIG. 8*c*, an exemplary engine 10 is shown cut through middle along the shaft 22, so as to show another angle of the internal features of the components. A bell housing void 42 is seen within the bell housing 12. Additionally, at least one assembly bolt housing 46 is shown, which houses the assembly bolt channels 30 through the bell housing 12. The exemplary engine block 16 is cut through a pair of opposing cylinders 68 to show a piston assembly 70, and combustion chamber 72 for each cylinder 68. Additionally, the illustration shows a cam crank 74 on shaft 22. An exemplary intake cam 90 is similarly positioned on the shaft 22 as the cam crank 74. The exemplary intake cam 90 is positioned toward the front of engine 10 from the cam crank 74, and an exemplary exhaust cam 92 is positioned toward the rear of the engine 10 from the cam crank 74.

Figure 8D:
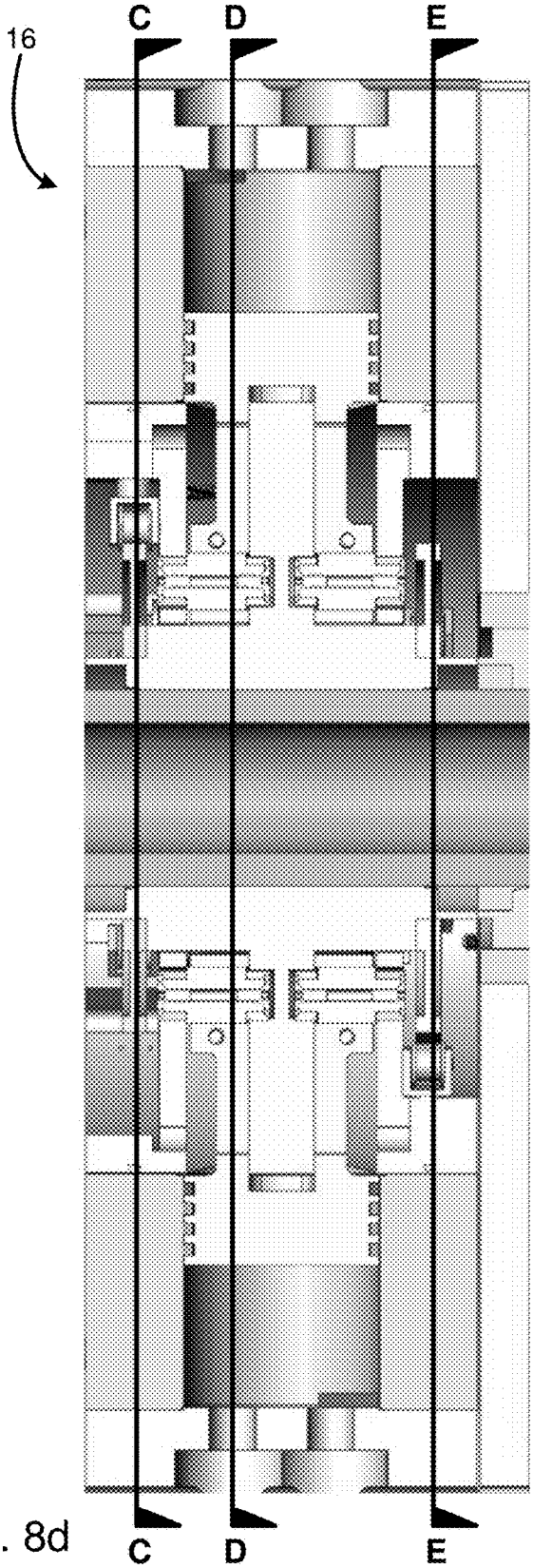
FIG. 8*d* is a side view of the engine block assembly shown in FIG. 8*b*.
Figure 8E:
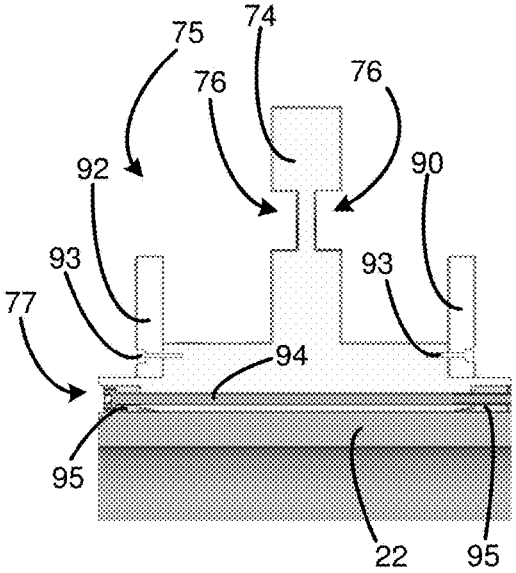
FIG. 8*e* is a cut-through side view of a detailed portion of a cam crank assembly.

Referring now also to FIG. 8*d*, a portion an exemplary engine block 16 is shown cut through middle along the shaft 22, and annotated with view that depict the approximate view perspective of later figures. Referring now also to FIG. 8*e*, an exemplary cam crank assembly 75 is shown with particular detail to an exemplary shaft securement assembly 77. Exemplary cam crank assembly 75 may comprise a cam crank 74, an intake cam 90, and an exhaust cam 92. In the exemplary embodiment, intake cam 90 and exhaust cam 92 are removably attached parallel to the cam crank 74, on opposing sides of the cam crank 74, by mounting screws 93. The exemplary cam crank assembly 75 encircles the shaft 22, coaxial to and perpendicular to the rotatable axis of the shaft 22.

In the exemplary embodiment, the cam crank assembly 75 may be secured to the shaft 22 by a shaft securement assembly 77. The exemplary shaft securement assembly 77 may comprise a securing bolt 94, and a tapered bushing 95. In the exemplary embodiment, a plurality of securing bolts 94 extend from a side of the intake cam 90 distal the exhaust cam 92 through the intake cam 90, cam crank 74, and exhaust cam 92, to be secured in place on the opposite side of exhaust cam 90. The exemplary securing bolt 94 secures a tapered bushing 95 on the side of each the intake cam 90 and the exhaust cam 92 distal the cam crank 74. So configured, as the securing bolt 94 is tightened against the tapered bushings 95, the tapered bushings 95 are drawn inward, toward the cam crank 74, wedging the tapered body of the tapered bushing 95 between the cam crank assembly 75 and the shaft 22, removably securing the cam crank assembly 75 to the shaft 22.

Figure 9A:
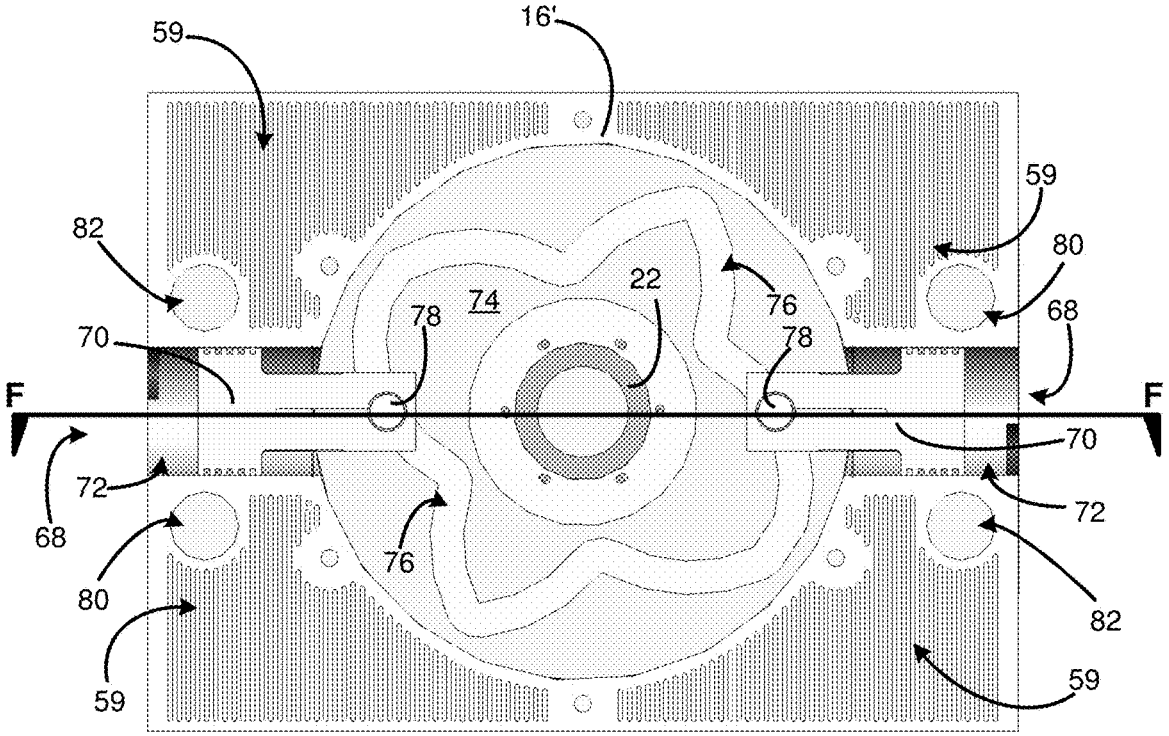
FIG. 9*a* is a normal front view of an alternate engine embodiment of the current disclosure, cut so as to show cylinders and pistons of an engine bank.

Focusing now on FIG. 9*a*, an alternate exemplary block 16' is shown cut perpendicular to the shaft 22. The exemplary embodiment may have a single pair of opposed cylinders 68, which configuration will be referred to herein as an "opposed" configuration to differentiate this single-pair configuration from the preciously described radial configuration that also may have pairs of opposed cylinders 68. In the exemplary embodiment, each exemplary cylinder 68 comprises a piston assembly 70 positioned to slide linearly within a combustion chamber 72. It is envisioned that an engine block 16' may have a single cylinder 68, if the piston assembly 70 is appropriately counter-weighted (not shown).

As with the exemplary embodiment of engine block 16, in FIGS. 8*a*, 8*b*, and 8*c*, the exemplary engine block 16' may have cylinders 68 arranged around a cam crank 74. Other similar features may include a precisely patterned piston crank groove 76 formed into a surface of the cam crank 74, piston travelers 78 connected to the piston and positioned in a piston crank groove 76, and an alignment plate 84 with alignment channels 85, which may provide support against forces that may push on a piston assembly 70 outwardly of a desired position within the cylinder 68.

Fuel mixture may be channeled to a combustion chamber 72 via a respective intake channel 80. Similarly, the exhaust created by combustion may be channeled out of the combustion chamber 72 via a respective exhaust channel 82. Each intake channel 80 is in fluid communication with the fuel mixture intake orifice 32 and a respective combustion chamber 72. Similarly, each exhaust channel 82 is in fluid communication with a respective combustion chamber 72 and an exhaust orifice 38. It is appreciated that the engine 10 may be adapted with a fuel injection system (not shown), eliminating the need for the intake channel 80.

The exemplary engine block 16' is cut through the pair of opposing cylinders 68 to show a piston assembly 70, combustion chamber 72, piston traveler 78, cylinder head 86, and an exemplary pair of spark plug wells 88 for each cylinder 68. Additionally, the illustration shows a cam crank 74 on shaft 22, in which is formed a piston crank groove 76. Similarly positioned on the shaft 22 as the cam crank 74 is an exemplary intake cam 90 toward the front of engine 10 from the cam crank 74, and an exemplary exhaust cam 92 toward the rear of the engine 10 from the cam crank 74.

Exemplary embodiment engine block 16' may be air-cooled. Air may be directed through the cooling fins 59 to conduct thermal transfer. It is envisioned that as additional engine blocks 16' may be modularly added to an opposed engine 10' subsequent engine blocks 16' may be elongated outwardly toward the cylinder head 86 in order to make cooling fins 59 of subsequent engine blocks 16' gain access to fresh, unheated air. (Such configurations are shown later in this disclosure.)

Figure 10:
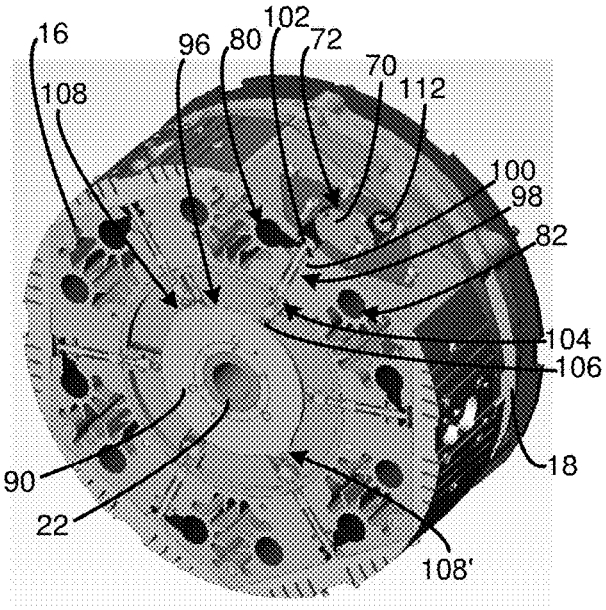
FIG. 10 is an oblique front view of the engine block and manifold in FIG. 1, cut through the engine block assembly at line C-C, shown in FIG. 8*d*.

Focusing now on FIG. 10, a front portion of the engine block 16 is removed to expose an exemplary intake cam 90 mounted perpendicularly onto a shaft 22, and having an intake cam edge 96. This descripting will focus on a single one of the cylinders 68, but the components, features, and their operation and relationship are replicated in each individual cylinder 68. Also exposed is the valve assembly 98, which may be held in place in the engine block 16 by a valve retainer 100 inserted in a valve retainer slot 64. The exemplary valve assembly 98 may have an intake valve 102 at least partially positioned within the intake channel 80 to facilitate controlled entry of fuel mixture into a combustion chamber 72. The intake cam edge 96 may be precisely contoured to communicate the coordinated timing for each intake valve 102 to open and close. An exemplary hydraulic lifter 104 may be positioned intermediate the valve assembly 98 and the intake cam edge 96, with a lifter roller 106 pressed against the intake cam edge 96. An exemplary raised intake section 108 in the intake cam edge 96 will cause the hydraulic lifter 104 to lift the valve 102, to facilitate the flow of fuel mixture through intake channel 80 and into combustion chamber 72.

Figure 11:
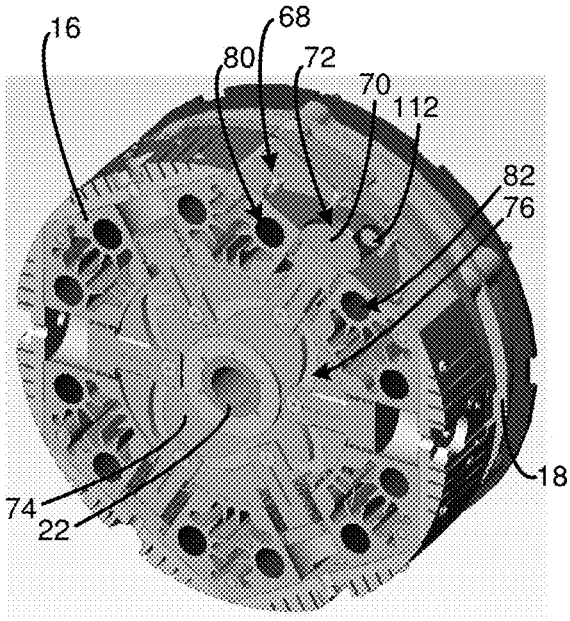
FIG. 11 is an oblique front view of the engine block and manifold in FIG. 1, cut through the engine block assembly at line D-D, shown in FIG. 8*d*.

Focusing now on FIG. 11, a front portion of the engine block 16 is removed to expose an exemplary cam crank 74 mounted perpendicularly onto a shaft 22, and having a piston crank groove 76. Also exposed is a piston assembly 70 and a piston traveler 78, as well as a portion of the intake channel 80 and exhaust channel 82.

Figure 12:
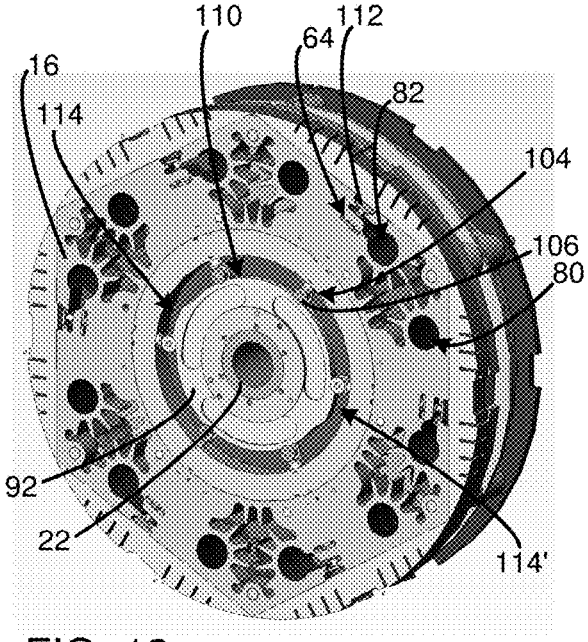
FIG. 12 is an oblique front view of the engine block and manifold in FIG. 1, cut through the engine block assembly at line E-E, shown in FIG. 8*d*.

Focusing now on FIG. 12, a front portion of the engine block 16 is removed to expose an exemplary exhaust cam 92 mounted perpendicularly onto a shaft 22, and having an exhaust cam edge 110. A portion of the exemplary exhaust valve 112 is exposed, along with a portion of the exhaust channel 82. The configuration may be similar to the intake, in that an exhaust valve 112 may be at least partially positioned within the exhaust channel 82 to facilitate controlled exit of exhaust from a combustion chamber 72. The exhaust cam edge 110 may be precisely contoured to communicate the coordinated timing for each exhaust valve 112 to open and close. An exemplary hydraulic lifter 104 may be positioned intermediate the exhaust valve 112 and the exhaust cam edge 110, with a lifter roller 106 pressed against the exhaust cam edge 110. An exemplary raised exhaust section 114 in the exhaust cam edge 110 will cause the hydraulic lifter 104 to lift the exhaust valve 112, and facilitate a flow of spent fuel mixture through exhaust channel 82 and through the manifold 18.

Figure 9B:
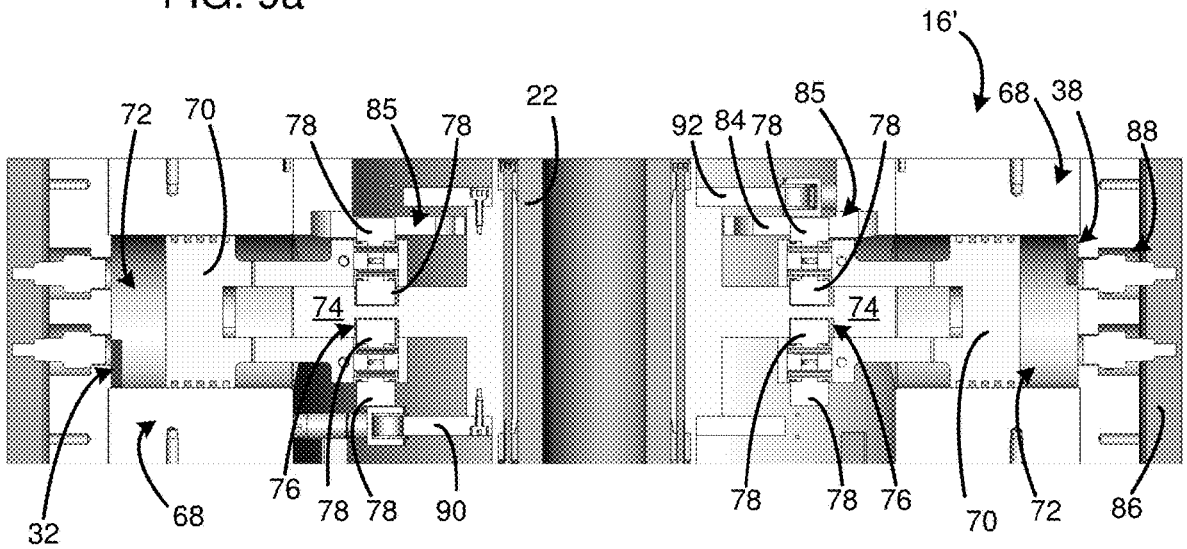
FIG. 9*b* is a side view of the engine shown in FIG. 9*a*, cut at the line F-F.

Referring now to FIGS. 13 through 20, components of the exemplary manifold 18, previously shown in FIGS. 2, 3, and 9, are shown in detail, separately and partially assembled to the exemplary engine 10. Exemplary manifold 18 has a generally cylindrical outer shape to correspond to the cylindrical shape of the exemplary engine block 16 for a radial embodiment of engine 10. It is appreciated that the exterior shape of the manifold 18 may correspond to the general exterior shape of alternate embodiments of the engine 10.

Figure 13:
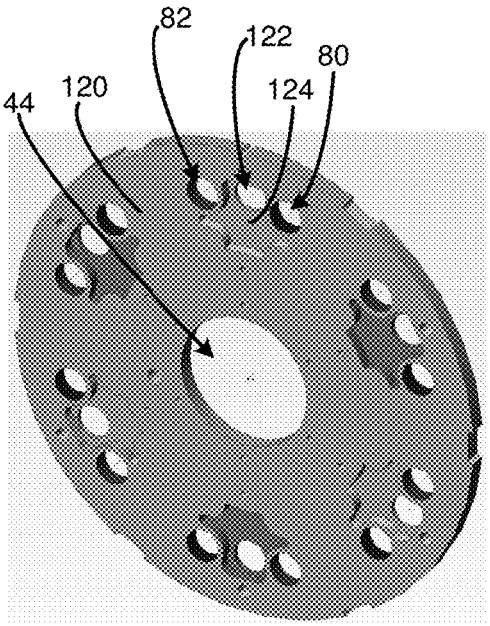
FIG. 13 is an oblique front view of an exemplary manifold rear mounting plate.
Figure 14:
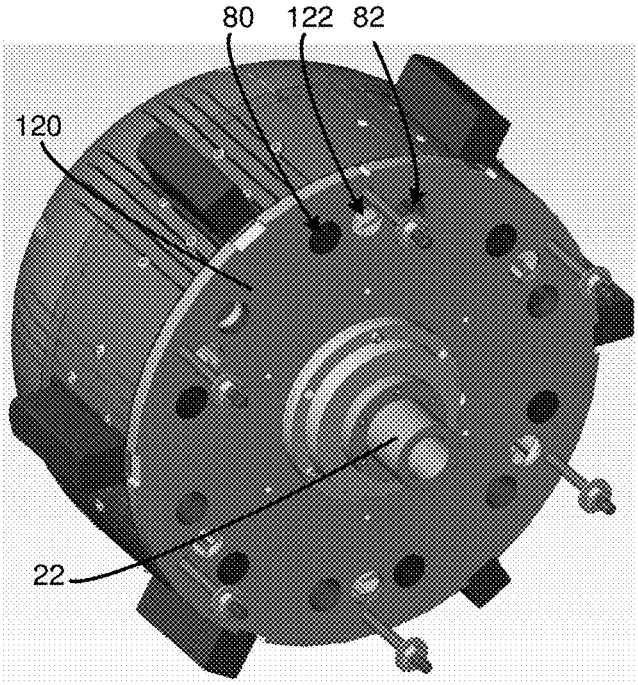
FIG. 14 is an oblique rear view of the engine in FIG. 1 with a portion of the manifold assembly removed to expose the rear of the manifold rear mounting plate shown in FIG. 13.

Focusing now on FIG. 13, the front side of an exemplary manifold rear mounting plate 120 is shown. The exemplary manifold rear mounting plate 120 may have a flat front side and a flat rear side, and an exterior shape similar to the general shape of the engine block 16 for which is it suited. With the exemplary radial design engine 10, the exterior shape is generally cylindrical. Each of the six cylinders 68 may have an intake channel 80, a coolant channel 122, and an exhaust channel 82. Additionally, the front side may have a coolant recess 124 surrounding the coolant channel 122, to facilitate distribution of coolant into the coolant jacket section 58 within the engine block 16. The manifold rear mounting plate 120 may be in direct contact with the engine block 16, and as such the seal between the engine block 16 and the manifold rear mounting plate 120 ensures fluids and gases within the engine stay contained. Now, also focusing on FIG. 14, the manifold rear mounting plate 120 is shown on the exemplary engine 10. A rear portion of the manifold 18 is removed to expose a rear side of an exemplary manifold rear mounting plate 120. It can be appreciated that parts in direct contact may have an intermediate gasket therebetween.

Figure 15:
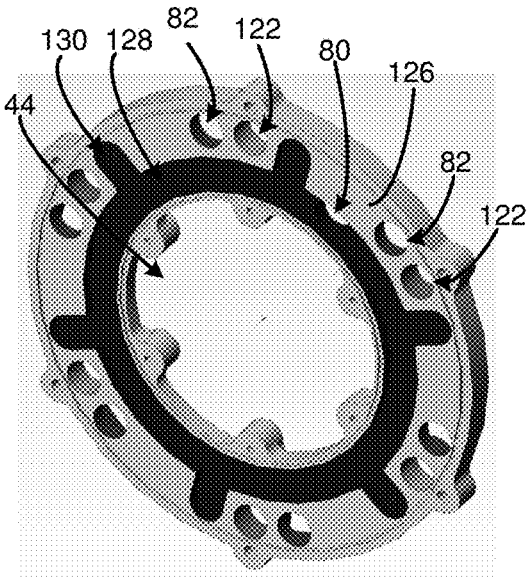
FIG. 15 is an oblique front view of an exemplary manifold channel plate.

Focusing now on FIG. 15, the front side of an exemplary manifold channel plate 126 is shown to house the intake channel 80, the exhaust channel 82, and the coolant channel 122. The exemplary manifold channel plate 126 may have a flat front side and a flat rear side, and an exterior shape similar to the general shape of the engine block 16 for which is it suited. Additionally, the manifold channel plate 126 may have a central shaft hole 44 and an intake distribution channel 128. The shaft hole 44 allows for the shaft 22 to extend from the rear of the engine 10. The exemplary intake distribution channel 128 is oriented around the circumference of the shaft hole 44 of the front side of the manifold channel plate 126. A distribution channel finger 130 extends outwardly from the intake distribution channel 128 at each cylinder 68, to communicate the fuel mixture for a particular cylinder 68.

Figure 16:
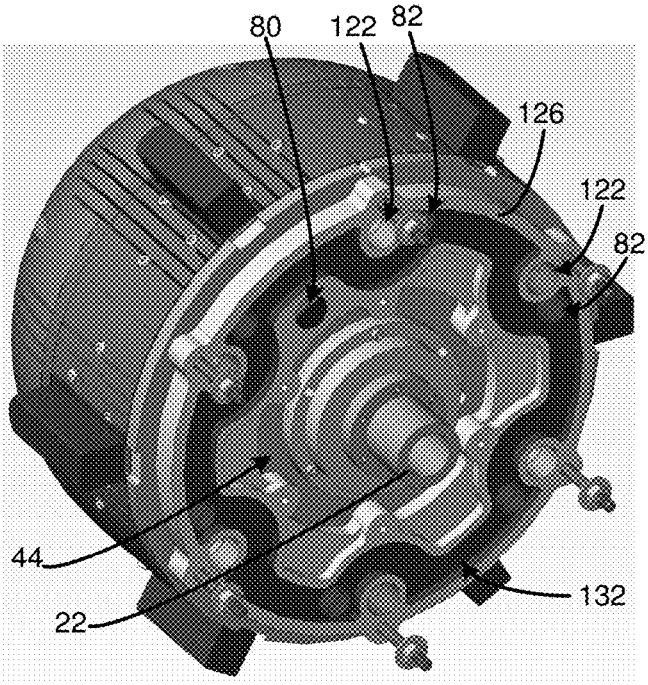
FIG. 16 is an oblique rear view of the engine in FIG. 1 with a portion of the manifold assembly removed to expose the rear side of the manifold channel plate.

Focusing also now on FIG. 16, the rear side of the exemplary manifold channel plate 126 is shown to house the shaft hole 44, the intake channel 80, the exhaust channel 82, and the coolant channel 122. Additionally, an exhaust collection channel 132 may be oriented around the circumference of the shaft hole 44 of rear side of the manifold channel plate 126. An exhaust channel 82 from each cylinder 68 may feed into the exhaust collection channel 132.

Figure 17:
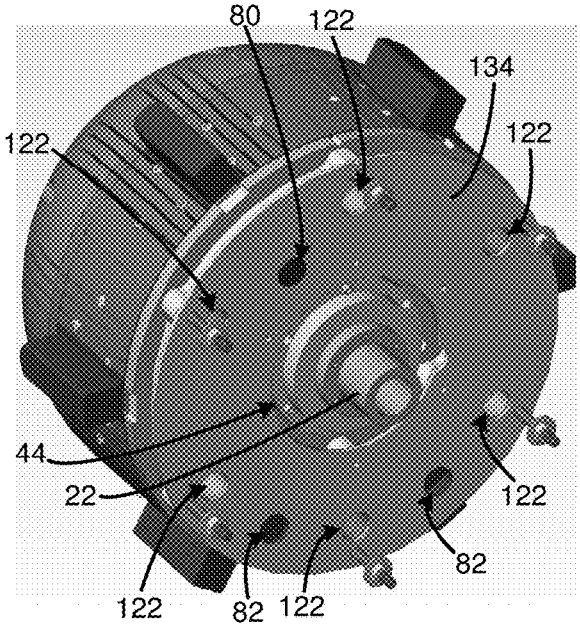
FIG. 17 is an oblique rear view of the engine in FIG. 1 with a portion of the manifold assembly removed to expose the rear of an exemplary manifold separation plate.

Focusing now on FIG. 17, the rear side of the exemplary manifold separation plate 134 is shown to have a central shaft hole 44, at least one intake channel 80, at least one exhaust channel 82, and a plurality of coolant channels 122. The exemplary manifold separation plate 134 may have a flat front side and a flat rear side, and an exterior shape similar to the general shape of the engine block 16 for which is it suited. In the exemplary embodiment, the manifold separation plate 134 covers the exhaust collection channel 132, and directs the communication of exhaust from an exhaust channel 82 for each cylinder 68 into a reduced number of exhaust channels 82 for controlled release from the engine 10. Controlled release may include noise muffling, emissions control, and providing power to a turbocharger.

Figure 18:
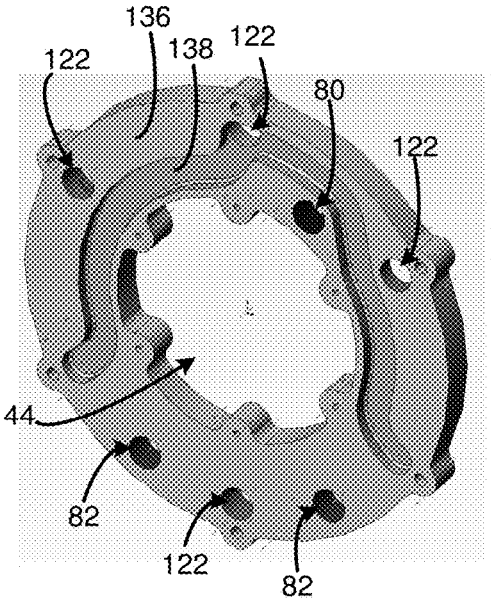
FIG. 18 is an oblique front view of an exemplary coolant plate.

Focusing now on FIG. 18, the front side of an exemplary coolant plate 136 is shown to house the intake channel 80, the exhaust channel 82, and the coolant channel 122. The exemplary manifold coolant plate 136 may have a flat front side and a flat rear side, and an exterior shape similar to the general shape of the engine block 16 for which is it suited. Additionally, the manifold coolant plate 136 may have a central shaft hole 44 and a coolant entry channel 138 along which coolant entering the engine is distributed from a single coolant channel 122 to multiple coolant channels 122 that lead to inlet coolant jacket sections 58. The shaft hole 44 allows for the shaft 22 to extend from the rear of the engine 10. The exemplary coolant entry channel 138 may be oriented partially around the circumference of the shaft hole 44 of the front side of the manifold coolant plate 136.

Figure 19:
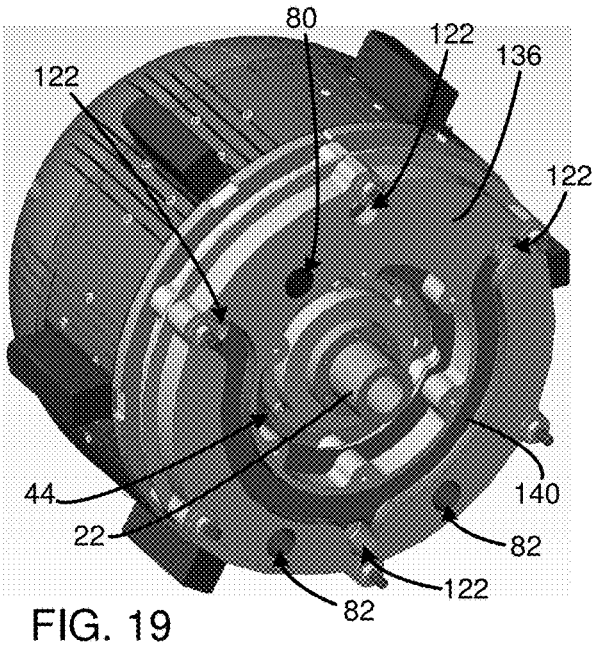
FIG. 19 is an oblique rear view of the engine in FIG. 1 with a portion of the manifold assembly removed to expose the rear of the coolant plate shown in FIG. 18.

Focusing also now on FIG. 19, the rear side of the exemplary manifold coolant plate 136 is shown to house the shaft hole 44, the intake channel 80, the exhaust channel 82, and the coolant channel 122. Additionally, a coolant return channel 140 is oriented partially around the circumference of the shaft hole 44 of rear side of the manifold coolant plate 136. The coolant return channel 140 supports the consolidating communication of coolant (not shown) returning from the coolant jacket sections 58 of the engine block 16 from multiple coolant channels 122 to a single coolant channel 122. Consolidating coolant may facilitate coolant management, which may include filtering, heat dissipation, and pumping.

Figure 20:
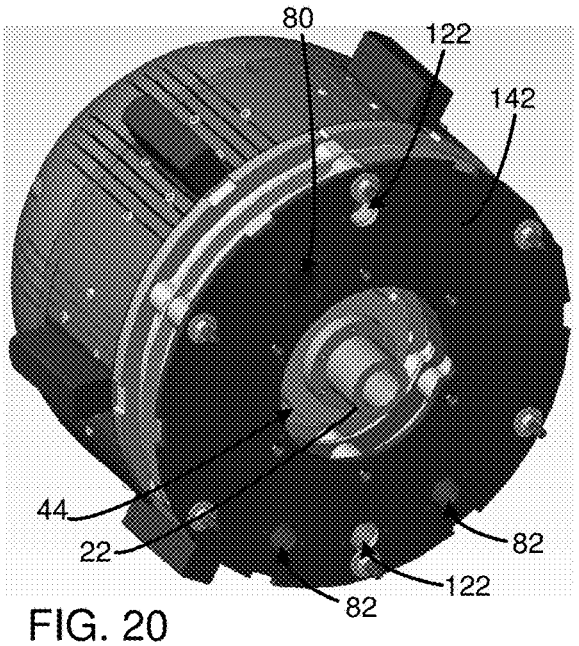
FIG. 20 is an oblique rear view of the engine in FIG. 1 showing an exemplary rear plate of the manifold installed on the coolant plate.

Focusing now on FIG. 20, an exemplary rear plate 142 is shown installed on the manifold coolant plate 136. The exemplary rear plate 142 is shown to house the shaft hole 44, the intake channel 80, the exhaust channel 82, and both an inlet and outlet of the coolant channel 122. The exemplary rear plate 142 may have a flat front side and a flat rear side, and an exterior shape similar to the general shape of the engine block 16 for which is it suited. In the exemplary embodiment, the rear plate 142 covers the coolant return channel 140, and seals the communication of coolant returning from the coolant jacket sections 58 of the engine block 16 from multiple coolant channels 122 to a single coolant channel 122.

Figure 22A:
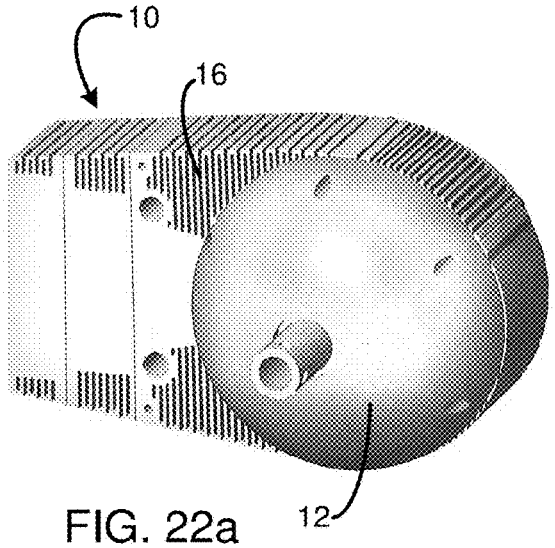
FIG. 22*a* is an oblique top frontal view of an alternate exemplary engine according to the present invention.
Figure 22B:
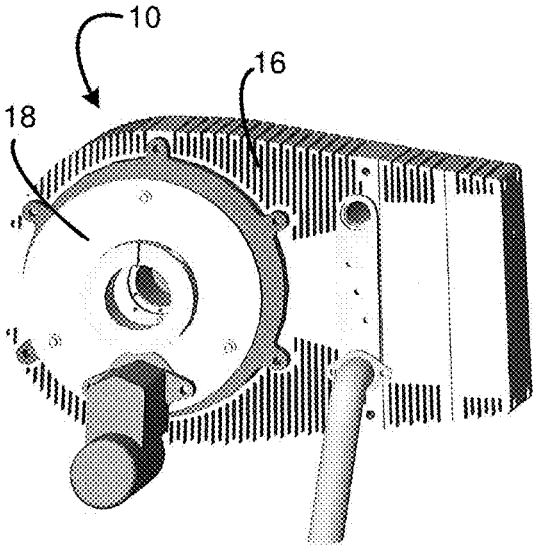
FIG. 22*b* is an oblique top rear view of the engine in FIG. 22*a*.
Figure 23:
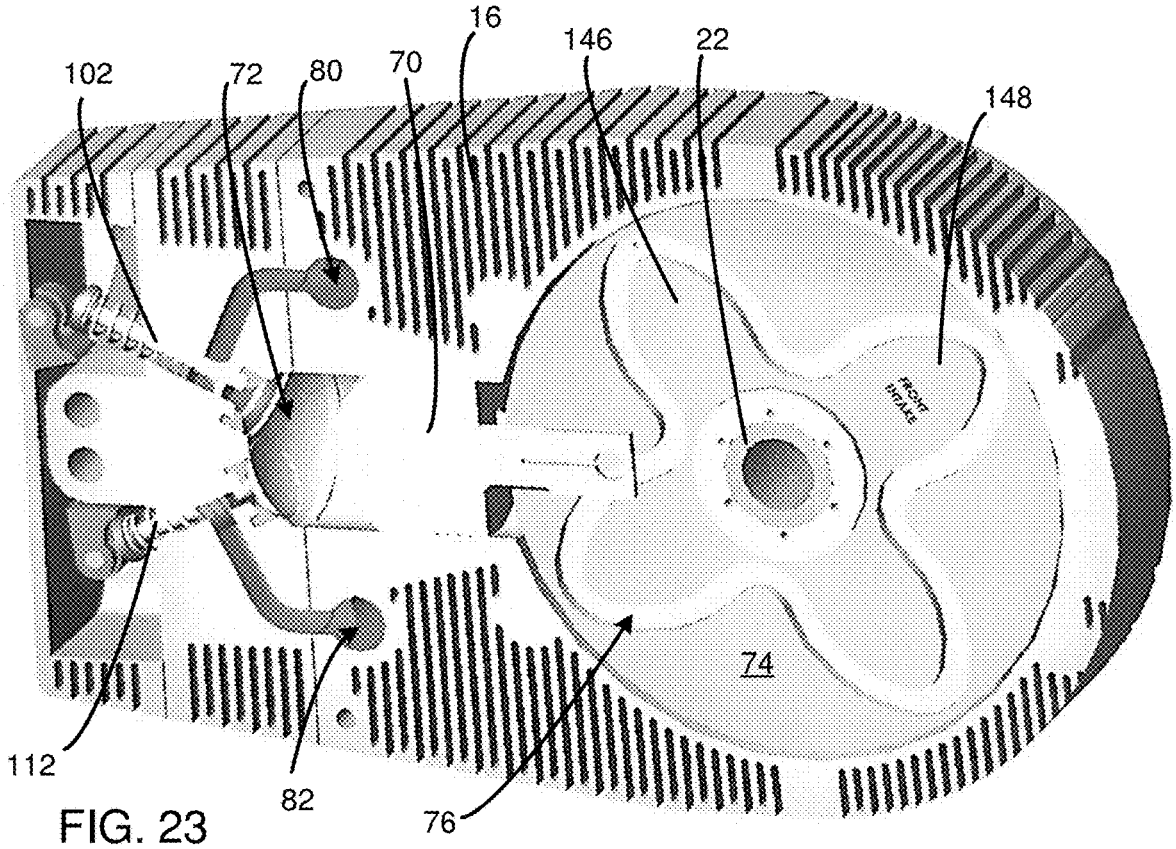
FIG. 23 is an oblique perspective view of the engine in FIG. 22*a*, cut perpendicularly to the shaft adjacent to the cam crank.

Referring now primarily to FIGS. 22 through 24, as well as FIGS. 11 through 13, details are provided on the correlation between exemplary shapes and features of an exemplary cam crank 74, an exemplary intake cam 90, an exemplary exhaust cam 92, the position of an exemplary piston assembly 70 within a corresponding combustion chamber 72, the position of an exemplary intake valve 102 within a corresponding intake channel 80, and the position of an exemplary exhaust valve 112 within a corresponding exhaust channel 82. In general, the pattern of the piston crank groove 76 determines the linear movement of the piston assembly 70 within the combustion chamber 72, though, in function, movement of the piston assembly 70 within the combustion chamber 72 applies force to the piston crank groove 76, which creates rotation in the cam crank 74, and therefore the rotationally linked shaft 22, intake cam 90, and exhaust cam 92. The performance and function of an engine 10 may be adjusted and adapted by changing the pitch and length of the slopes, and the duration and abruptness of the bottom and top slope transitions.

In the exemplary embodiment, the cam crank 74, the intake cam 90, and the exhaust cam 92 are all securely attached perpendicular to the shaft 22, which results in the cam crank 74, the intake cam 90, and the exhaust cam 92 being oriented in parallel planes to each other. Additionally, the cam crank 74, the intake cam 90, and the exhaust cam 92 rotate simultaneously with the shaft 22, so that their rotational position is coordinated and synchronized. Each of the cam crank 74, the intake cam 90, and the exhaust cam 92 will complete one 360 degree rotation about the axis of the shaft 22 at the identically same time. In this manner, features on one of the cam crank 74, the intake cam 90, and the exhaust cam 92 that affect an action within the engine 10 can be coordinated with the other of the cam crank 74, the intake cam 90, and the exhaust cam 92 to affect other actions within the engine 10 at related times to each other action. Reference line segments G-G and H-H, which are to be seen as fixed on the shaft 22, so as to rotate simultaneously with the shaft 22, and therefore the cams (74, 90, 92), are provided to help depict the coordinated timing between the cam crank 74, the intake cam 90, and the exhaust cam 92, and therefore the actions that they affect within the engine 10.

Figure 21A:
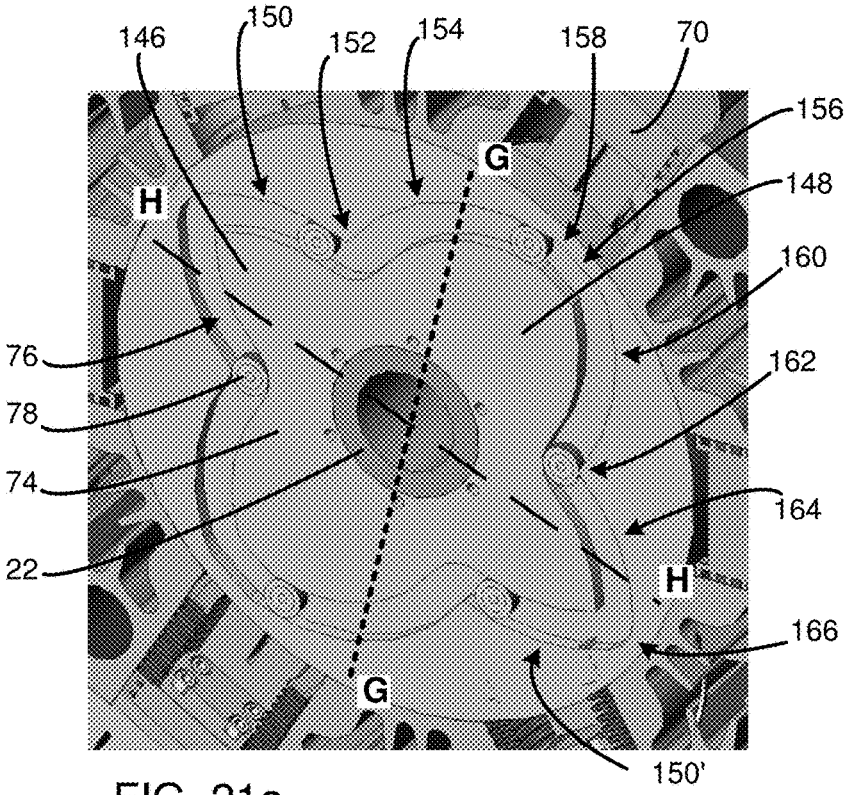
FIG. 21*a* is an enlarged oblique perspective view of the exemplary cam crank shown in FIG. 11.

Focusing now on FIG. 21*a*, the exemplary cam crank 74 may have a piston crank groove 76. A piston traveler 78 for each cylinder 68 in engine 10 may be positioned within the piston crank groove 76, so as to follow the shape of the piston crank groove 76 as the cam crank 74 rotates about the axis of shaft 22. The shape of the piston crank groove 76 moves through a range of positions that range from a position close to the axis of shaft 22 to a position distal the axis of shaft 22. In the exemplary embodiment, as a piston assembly 70 may be moved within the combustion chamber 72, a connection between the piston traveler 78 and the piston assembly 70 pushes the piston traveler 78 downward. When the piston assembly 70 is high in the combustion chamber 72, the piston traveler 78 is in a position distal the axis of shaft 22. When the piston assembly 70 is low in the combustion chamber 72, the piston traveler 78 is in a position close to the axis of shaft 22. The piston traveler 78 stays in the piston crank groove 76 and follows the slopes of the piston crank groove 76 causing rotation of the cam crank 74.

In the exemplary embodiment, the shape of the piston crank groove 76 creates a transfer lobe 146 and a power lobe 148. The clockwise slope of the exemplary transfer lobe 146 that slopes inwardly toward the shaft 22 may be an intake slope 150. Continuing clockwise around the piston crank groove 76, an intake bottom 152 marks the transition from the transfer lobe 146 to the power lobe 148. The intake bottom 152 is intermediate the intake slope 150 and a compression slope 154. The compression slope 154 slopes outwardly from the shaft 22 on power lobe 148. At the apex of the compression slope 154 the slope has a compression top 156. In the exemplary embodiment, the compression top 156 may have a compression pause 158. A compression pause 158 may be a short rotational distance where the piston crank groove 76 remains the same distance from the shaft 22.

The clockwise slope of the exemplary power lobe 148 that slopes inwardly toward the shaft 22 may be a power slope 160. Continuing clockwise around the piston crank groove 76, a power bottom 162 marks the transition back to the transfer lobe 146 from the power lobe 148. The power bottom 162 is intermediate the power slope 160 and an exhaust slope 164. The exhaust slope 164 slopes outwardly from the shaft 22 on transfer lobe 148. At the apex of the exhaust slope 164 the slope has an intake top 166. Continuing clockwise around the piston crank groove 76, the sequence repeats, starting with another intake slope 150'. In the exemplary embodiment, the cam crank 74 may have a piston crank groove 76 with two transfer lobes 146 and two power lobes 148 that will result in each cylinder 68 having two power strokes per cylinder 68 per revolution of the shaft 22, when operating with a four-stroke combustion cycle. A piston crank groove 76 with two transfer lobes 146 and two power lobes 148 is a characteristic of an exemplary engine 10 running on a four-stroke combustion cycle.

Figure 21B:
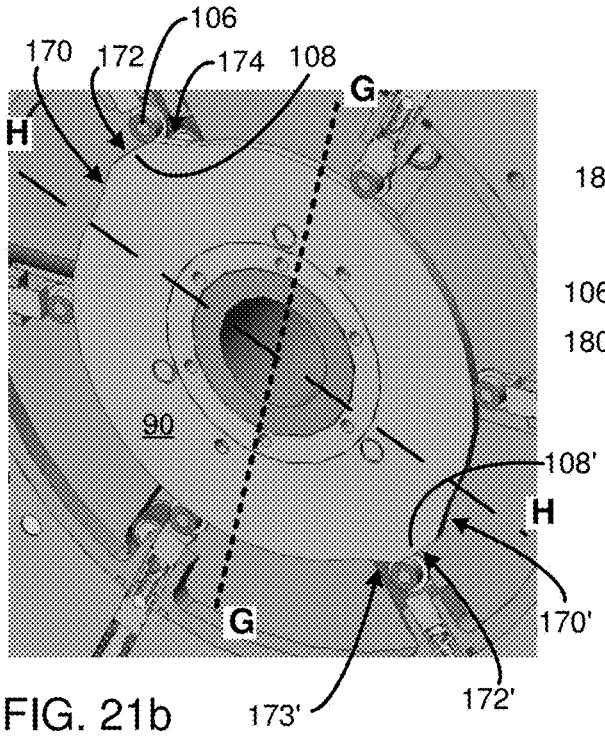
FIG. 21*b* is an enlarged oblique perspective view of the exemplary intake cam disk shown in FIG. 10.

Focusing now on FIG. 21*b*, the exemplary intake cam 90 may affect movement in the intake valve 102 within the intake channel 80. Each intake valve 102 may be moved between an open and a closed position through linkage to a particular hydraulic lifter 104 and lifter roller 106. The particular hydraulic lifter 104 and lifter roller 106 cause a respective intake valve 102 to move in response to a coordinated feature a lifter roller 106 may encounter on the intake cam 90. In the exemplary embodiment, a coordinated feature may be either of the raised intake sections (108, 108') on the intake cam edge 96.

Proceeding clockwise around the intake cam edge 96 from the upper intersection of the intake cam edge 96 with line segment H-H, the lifter roller 106 may encounter an intake opening slope 170. An intake opening slope 170 may be a slight upward slope away from the shaft 22 on the intake cam edge 96. The intake opening slope 170 may lead to an intake open plateau 172, which may be a short rotational distance where the intake cam edge 96 remains the same distance from the shaft 22. An intake closing slope 174 may be at the end of the intake open plateau 172. The exemplary intake closing slope 174 may be where the lifter roller may be allowed to return to a position closer to the shaft 22, to a radius from the shaft 22 that the intake cam edge 96 predominantly holds along circumference of the intake cam 90.

In the exemplary embodiment, the raised intake section 108 may be encountered after a slight clockwise rotation of the intake cam 90 from the upper intersection of the intake cam edge 96 and line segment H-H, and well before the intake cam edge 96 intersects line segment G-G. In the exemplary embodiment, a subsequent raised intake section 108' may occur a slight clockwise rotation of the intake cam 90 from the lower intersection of the intake cam edge 96 and line segment H-H, and well before the intake cam edge 96 intersects line segment G-G again.

Figure 21C:
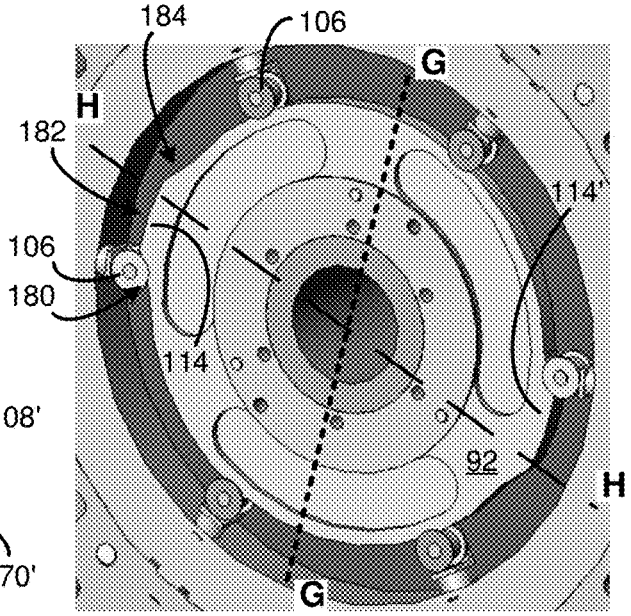
FIG. 21*c* is an enlarged oblique perspective view of the exemplary exhaust cam disk shown in FIG. 12.

Focusing now on FIG. 21*c*, the exemplary exhaust cam 92 may affect movement in the exhaust valve 112 within the exhaust channel 82. Each exhaust valve 112 may be moved between an open and a closed position through linkage to a particular hydraulic lifter 104 and lifter roller 106. The particular hydraulic lifter 104 and lifter roller 106 may cause a respective exhaust valve 112 to move in response to a coordinated feature a lifter roller 106 may encounter on the exhaust cam 92. In the exemplary embodiment, the coordinated feature may be either of the raised exhaust sections (114, 114') on the exhaust cam edge 110.

Proceeding clockwise around the exhaust cam edge 110 from slightly before the upper intersection of the exhaust cam edge 110 with line segment H-H, the lifter roller 106 may encounter an exhaust opening slope 180. An exhaust opening slope 180 may be a slight upward slope away from the shaft 22 on the exhaust cam edge 110. The exhaust opening slope 180 may lead to an exhaust open plateau 182, which may be a short rotational distance where the exhaust cam edge 110 remains the same distance from the shaft 22. In the exemplary embodiment, the upper intersection of the exhaust cam edge 110 and line segment H-H occurs during the exhaust open plateau 182. An exhaust closing slope 184 may be at the end of the exhaust open plateau 182. At the exemplary exhaust closing slope 184 the lifter roller may be allowed to return to a position closer to the shaft 22, to a radius from the shaft 22 that the exhaust cam edge 110 predominantly holds along circumference of the exhaust cam 92.

In the exemplary embodiment, the raised exhaust section 114 may be encountered generally at the upper intersection of the exhaust cam edge 110 and line segment H-H. In the exemplary embodiment, a subsequent raised exhaust section 114' may occur generally at the lower intersection of the exhaust cam edge 110 and line segment H-H, during the exhaust open plateau 182.

During engine 10 function movement in the piston assembly 70 within the combustion chamber 72 affects rotation in the cam crank 74, and therefore affects rotation in the shaft 22, and the rotationally fixed intake cam 90 and exhaust cam 92. Linkage between the cam crank 74, piston crank groove 76, piston traveler 78, and piston assembly 70 respond to combustion within the combustion chamber 72, which applies downward force to the piston assembly 70, which in turn applies force to the piston traveler 78. The piston traveler 78 transfers the force from the piston assembly 70 to the sides of the piston crank groove 76. The slope of the sides of the piston crank groove 76 translates the linear downward force into rotation of the cam crank 74. The shape of a piston crank groove 76 may directly affect the forces imparted on the shaft 22 from combustion in the connected combustion chambers 72 of an engine 10. Therefore, modifications to the shape of a piston crank groove 76 will modify the performance characteristics of the respective engine 10. Additionally, opposed cylinders 68, experiencing combustion at the same time, will neutralize each other's lateral forces, leaving only the force on the pair of piston crank groove 76 slopes to impart rotation in the shaft 22.

The affects caused by the coordinated features of the cam crank 74, intake cam 90 and exhaust cam 92, result in a sustained internal combustion cycle that results in powerful rotational velocity and torque being imparted into the shaft 22. The shaft 22 may then be attached to a wide assortment of devices to accomplish work. Referring to FIGS. 11 through 13, and 22 through 24, the coordinated workings of an exemplary piston assembly 70, intake valve 102, and exhaust valve 112 will be described.

Though a combustion cycle is a continual process, it may make sense to start the description of the interaction of the elements of an engine 10 at a point in the cycle of an exemplary cylinder 68 where fresh fuel is introduced into the engine 10. This position can be referenced as slightly counterclockwise of the upper intersection of any cam (74, 90, 92) and the line segment H-H. Rotation in the cam crank 74 results in the piston traveler 78 following the intake slope 150 of the piston crank groove 76. The inward movement of the piston traveler 78 draws the connected piston assembly 70 downward within the combustion chamber 72, creating space in the combustion chamber 72 for the introduction of an appropriate fuel mixture. In adjustable synchronization, the intake valve 102 is opened to permit fuel mixture to communicate through the intake channel 80 into the combustion chamber 72. Opening of the intake valve 102 is in response to the lifter roller 106 of that particular intake valve 102 experiencing the intake opening slope 170 on the intake cam edge 96. The intake valve 102 remains open in the intake channel 80 while the lifter roller 106 experiences the intake open plateau 172. The intake valve 102 closes when the lifter roller 106 for that intake valve 102 experiences the intake closing slope 174, on the intake cam edge 96. In adjustable synchronization, the exhaust valve 112 is closed within the exhaust channel 82, since the lifter roller 106 for that particular exhaust valve 112 is experiencing the lower position the exhaust cam edge 110 predominantly holds along circumference of the exhaust cam 92.

As the piston traveler 78 reaches the intake bottom 152, the intake valve 102 is closed, because the roller lifter 106 of the intake valve 102 has experienced the intake closing slope 174. The roller lifter 106 of the intake valve 102 will not experience another intake opening slope 170 until the shaft 22 and the cams (74, 90, 92) rotate almost 180 degrees, traveling past the lower intersection of the intake cam edge 96 and the line segment H-H. The exhaust valve 112 is still closed, because the lifter roller 106 for the exhaust valve 112 has still not experienced a raised exhaust section 114, and will not until just a few rotational degrees before the exhaust cam edge 110 intersects the line segment H-H.

With further rotation of the cam crank 74, the piston traveler 78 encounters the compression slope, and begins to raise the piston assembly 70 in the combustion chamber 72, pressurizing the fuel mixture contained therein. As mentioned, the intake valve 102 and the exhaust valve 112 are closed, so pressure within the combustion chamber 72 builds until the piston assembly 70 reaches its apex in the combustion chamber 72, which is when the piston traveler reaches the compression top 156. At this point, a sparkplug (not shown) positioned to affect spark in the combustion chamber 72 ignites the compressed fuel mixture. Combustion of the fuel mixture creates pressure that forces the piston assembly 70 downward at the same time the piston traveler 78 progresses into the power slope 160. The force on the piston assembly 70 is communicated through the piston traveler 78 and the slopes of the piston crank groove 76, and into the cam crank 74 and shaft 22 as rotational speed and torque.

In an exemplary engine 10 where the power lobe 148 has a compression pause 158 in the piston crank groove 76, ignition may be timed for when the piston traveler 78 reaches the beginning of the compression pause 158. During the compression pause 158 pressure from combustion is permitted to build within the combustion chamber 72 for a short time before the piston traveler 78 progresses into the power slope 160 and permits the piston assembly 70 to descend within the combustion chamber 72.

The rotation of the cam crank 74 causes the piston traveler 78 to reach the power bottom 162 and transition into the exhaust slope 164. The connection of the piston traveler 78 to the piston assembly 70 results in the piston reaching the lowest point in its travel within the combustion chamber 72 when the piston traveler 78 is at the power bottom 162. The piston assembly 70 moves upward within the combustion chamber 72 as when the piston traveler 78 experiences the exhaust slope 164. In the exemplary embodiment, these actions occur slightly before the piston traveler 78 and respective roller lifters 106 reach the lower intersection of the cams (74, 90, 92) and the line segment H-H. At that point in rotation, the intake valve 102 is still closed, because the lifter roller 106 for that particular exhaust valve 112 is experiencing the lower position the exhaust cam edge 110 predominantly holds along circumference of the exhaust cam 92. However, the lifer roller 106 of the exhaust valve 112, in adjustable synch with movement of piston assembly 70, reaches the subsequent raised exhaust section 114', and experiences the exhaust opening slope 180', opening the exhaust valve 112 within the exhaust channel 82, permitting the communication of exhaust from out of the combustion chamber 72 and into the exhaust channel 82 for exhaust management. The further progress of the piston traveler 78 along the exhaust slope 164 pushes the piston assembly 70 upward in the combustion chamber 72, assisting to evacuation of the exhaust from the combustion chamber 72 and into the exhaust channel 82.

In the exemplary embodiment, slightly before the piston traveler 78 reaches the intake top 166 at the end of the exhaust slope 164, which corresponds to the piston assembly 70 reaching the top of its stroke within the combustion chamber 72, the roller lifter 106 for the exhaust valve 112 experiences the exhaust closing slope 184. In response to experiencing the exhaust closing slope 184 the roller lifter 106 closes the exhaust valve 112 in the exhaust channel 82, halting the communication of exhaust from the combustion chamber 72. Continued rotation of the cams (74, 90, 92) bring the piston traveler 78 to the intake top 166, bring the roller lifter 106 for the intake valve 102 toward the subsequent raised intake section 108', and leaves the exhaust valve 112 closed, since the roller lifter 106 for the exhaust valve 112 will not experience another raised exhaust section 114 for almost 180 degrees of rotation of the shaft 22.

Referring now primarily to FIGS. 22*a* and 22*b*, an alternate exemplary embodiment of a single cylinder engine according to the present invention is shown. Referring now primarily to FIG. 23, such a single-cylinder engine may be configured, as with the engine of FIG. 8*a*, to support two transfer lobes 146 and two power lobes 148. Such a configuration will result in the exemplary engine possessing two power strokes per revolution of the shaft.

Figure 24A:
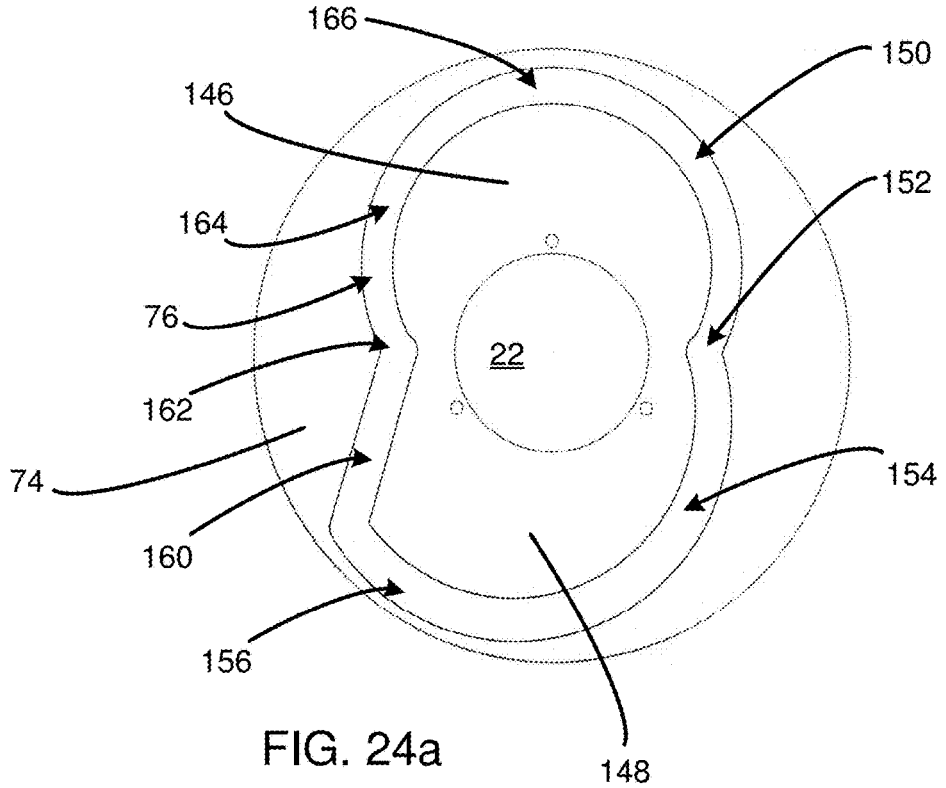
FIG. 24*a* is a depiction of an alternate exemplary cam crank.
Figure 24B:
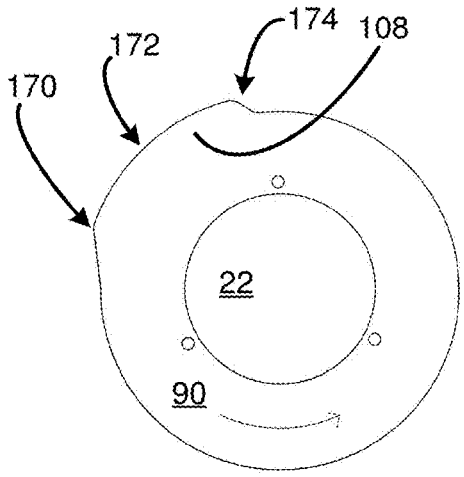
FIG. 24*b* is a depiction of an exemplary intake cam for use with the cam crank of FIG. 24*a*.
Figure 24C:
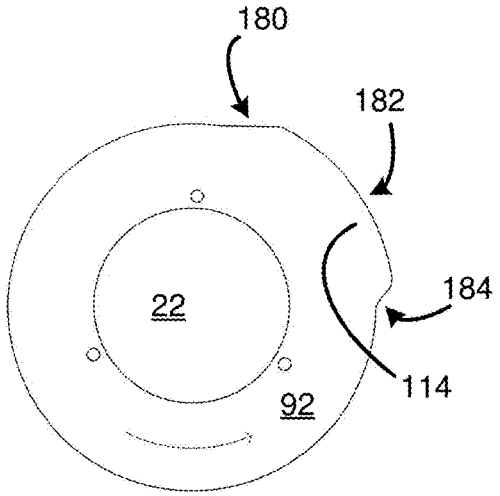
FIG. 24*c* is a depiction of an exemplary exhaust cam for use with the cam crank of FIG. 24*a*.

Referring now primarily to FIGS. 24*a*, 24*b*, and 24*c*, a cam set, which may comprise a cam crank 74, an intake cam 90 and an exhaust cam 92, may have a cam crank 74 with a cam crank groove 76 with a single transfer lobe 146 and a single power lobe 148. Such a configuration would result in the subject engine producing a single power stroke per revolution of the shaft. The stroke sequence may be similar to a conventional four-stroke engine. However, the varied shape of the radial cam crank groove 76 permits the modification of the engine performance in response to the forces created by combustion in a combustion chamber 72. The forces produced by the power stroke may be adapted and manipulated by the precise shape of the cam crank groove 76 to take mechanical advantage of the particular pressure created in the combustion chamber 72.

Figure 25:
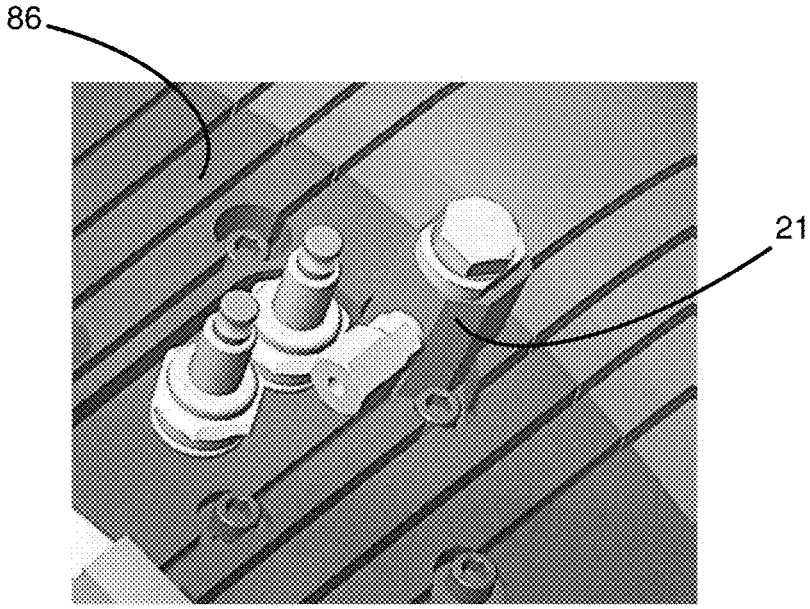
FIG. 25 is an oblique perspective view of an exemplary fuel injector adapted for use with an exemplary engine.
Figure 26:
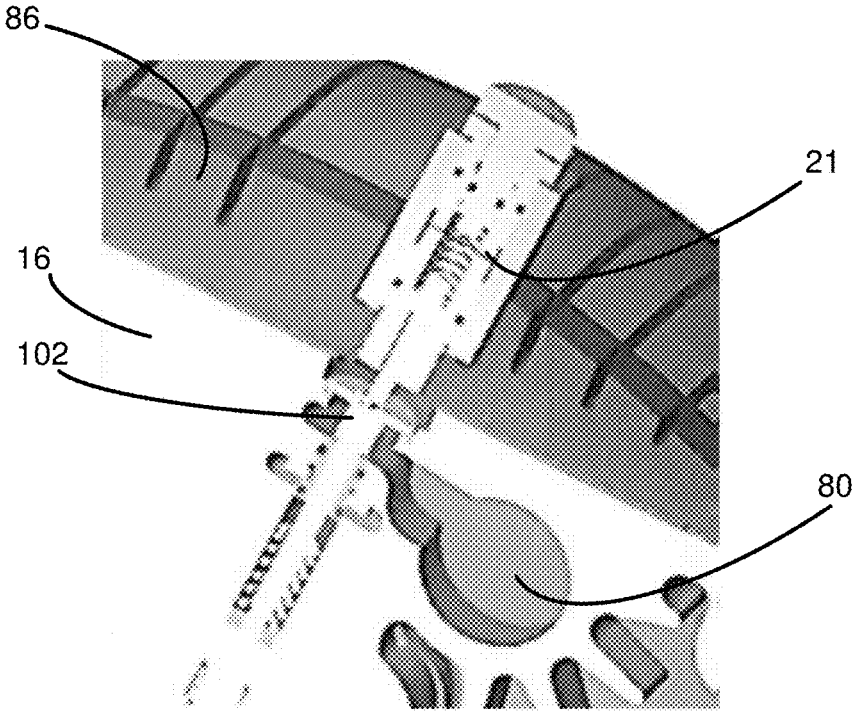
FIG. 26 is an exemplary cross-sectional view of the injector and engine of FIG. 25.

Referring now primarily to FIGS. 25 and 26, a fuel injector 21 is shown installed in an exemplary cylinder head 86. In the exemplary embodiment, a supply of air will still flow to the intake channel 80 through manifold 18. The exemplary injector 21 is configured to be in direct contact with the intake valve 102, such that the opening of the intake valve 102 opens the fuel injector 21, permitting an amount of fuel, supplied to the fuel injector 21, to enter the intake channel 80, and subsequently the combustion chamber 72.

Figure 27A:
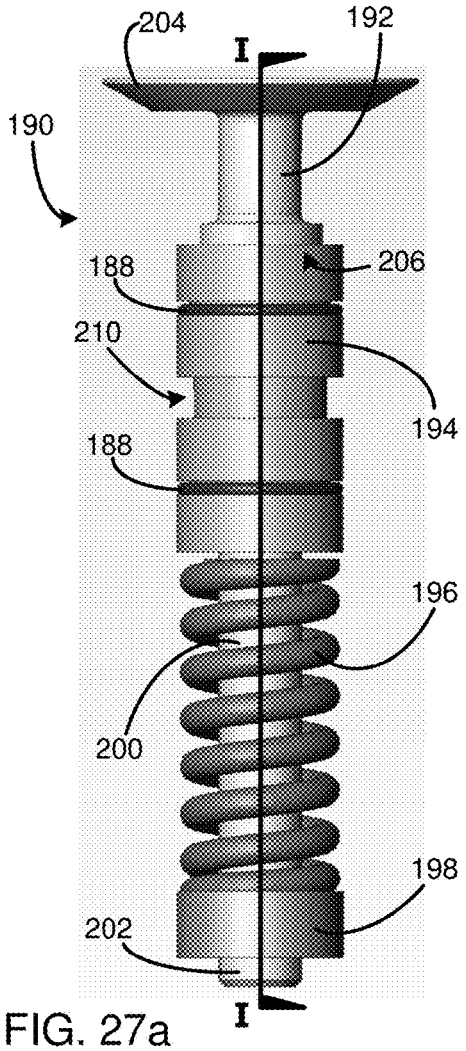
FIG. 27*a* is a side view of an exemplary valve assembly for the engine in FIG. 1.
Figure 27B:
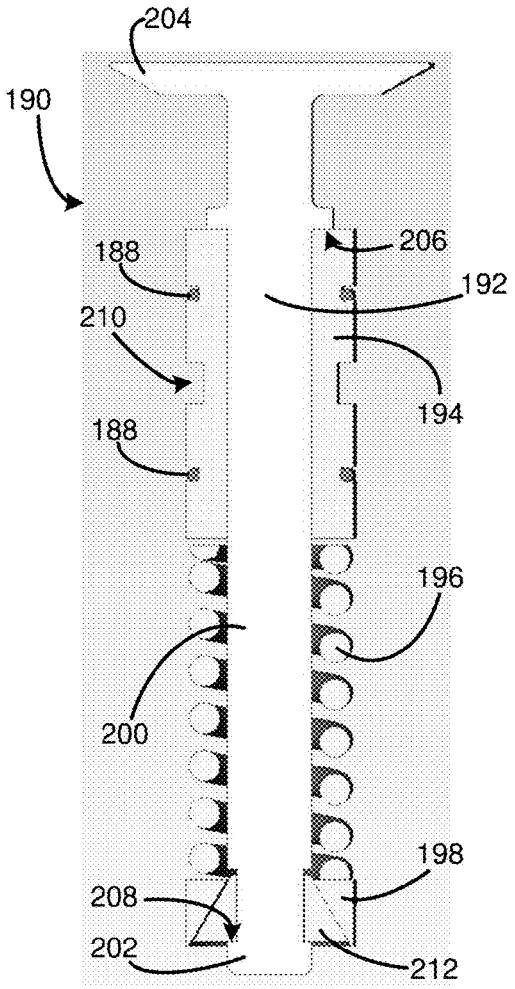
FIG. 27*b* is a side view of the valve assembly shown in FIG. 27*a*, cut at line I-I.
Figure 27C:
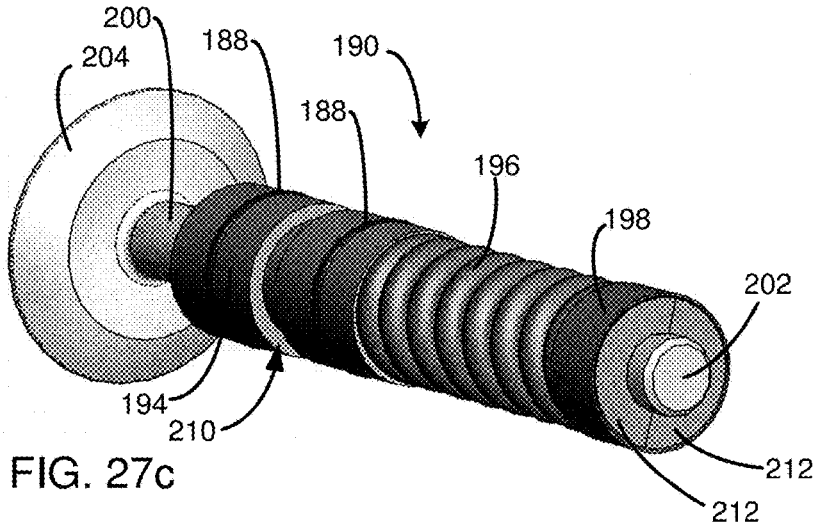
FIG. 27*c* is an oblique perspective view of the valve assembly shown in FIG. 27*a*.

Referring now primarily to FIGS. 27*a*, 27*b*, and 27*c*, an exemplary valve assembly 190 may have a valve 192, a valve guide 194, a spring 196, and a collet retainer 198. Exemplary valve 192 may have a valve stem 200, with a valve tip 202 on one end and a valve head 204 on the other end. The exemplary valve 192 may also have a valve neck shoulder 206 on the valve stem 200. In the exemplary embodiment, the valve neck shoulder 206 is a raised area that encircles the valve stem 200, creating an area of greater circumference along the length of the valve stem 200.

The exemplary valve guide 194 may have a cylindrical outer shape and a linear hollow passage through the center, along the length, through which a valve stem 200 may pass. The valve guide 194 is configured to slide along a length of a valve stem 200, and abut against the valve neck shoulder 206. The exemplary valve guide 194 may have a retainer groove 210 intermediate a pair of groove seals 188. The retainer groove 210 may be an area of lesser circumference along the length of the valve guide 194.

The exemplary spring 196 may have a spiral shape, sized to slide and surround a length of a valve stem 200. The exemplary spring 196 may abut against an end of a valve guide 194 to apply a force on the valve guide 194 toward the valve neck shoulder 206. In the exemplary embodiment, the spring 196 may be retained on in a position on the valve stem 200 by a collet retainer 198. The exemplary collet retainer 198 may provide an opposing surface to the valve neck shoulder 206 if a compressive force is applied to the valve 192 to push the valve neck shoulder 206 toward the collet retainer 206.

The exemplary collet retainer 206 may engage a pair of collets (212, 212') to be prevented from traveling past over the valve tip 202 and off the valve stem 200. An interlocking configuration of the collets (212, 212') and collet retainer 198, and the manner in which the collet retainer 198 draws the collets (212, 212') against the valve stem 200, and more specifically the valve tip 202 should be known by one of ordinary skill in the art.

Figure 28:
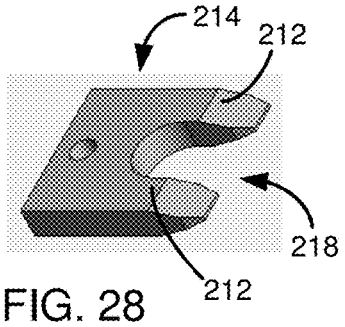
FIG. 28 is an oblique perspective view of a valve assembly retainer.

Referring now also to FIG. 28 and FIG. 7*a*, an exemplary valve assembly retainer 214 may have at least one prong 216, which may be shaped to define a guide void 218. In the exemplary embodiment, a valve assembly retainer 214 may be positioned within a valve retainer slot 64 in the engine block 16, with a valve assembly 190 in an installed position within an engine block 16, so as to impinge on both the valve guide 194 and the engine block 16, and secure the valve assembly 190 in position. With the exemplary valve assembly 190 in an installed position within an engine block 16, the retainer groove 210 of the valve guide 194 may align with the valve retainer slot 64 in the engine block 16. The valve assembly retainer 214 may then be inserted into the aligned valve retainer slot 64 and the retainer groove 210. In the exemplary embodiment, the valve assembly retainer 214 is inserted with the prongs 216 first, so beveled leading edges of the prong may guide the entry into the retainer groove 210. When the valve assembly retainer 214 is in a proper installed position, the valve guide 194 is positioned within the guide void 218, and the valve retainer impinges against the retainer groove 210 and the engine block 16.

Figure 29:
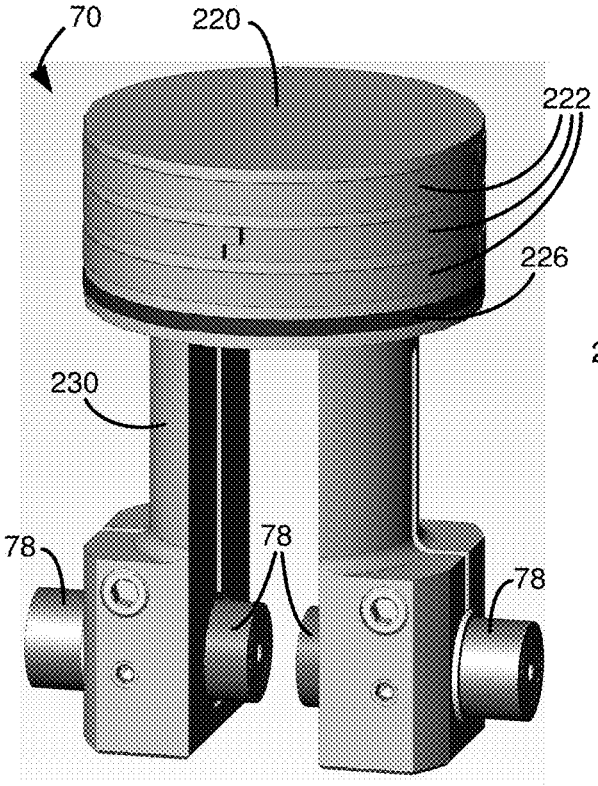
FIG. 29 is an oblique perspective view of an exemplary piston assembly for the engine in FIG. 1.
Figure 30:
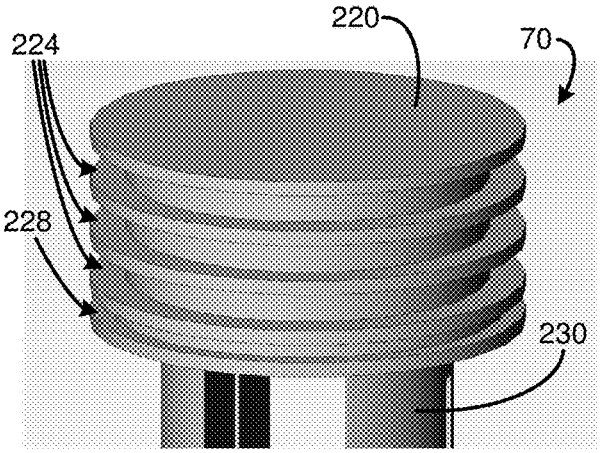
FIG. 30 is an alternate oblique perspective view of the piston assembly in FIG. 29.

Referring now primarily to FIGS. 29 and 30, an exemplary embodiment of a piston assembly 70 may have a piston head 220, one or more ring grooves 224, which in each may be positioned a ring 222, an oil ring 228, which in each may be positioned an oil ring 226, a piston neck, and at least one traveler 78. In the exemplary embodiment, the ring grooves 224 and rings 222, oil ring grooves 228 and oil rings 226 may be similar to those currently used in previously existing piston internal combustion engines.

Figure 31:
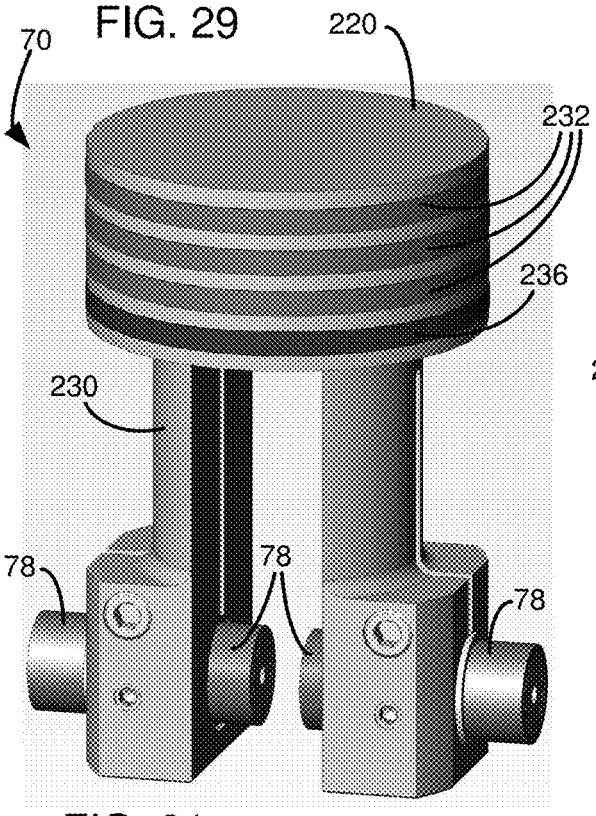
FIG. 31 is an oblique perspective view of an alternate exemplary piston assembly for the engine in FIG. 1.
Figure 32:
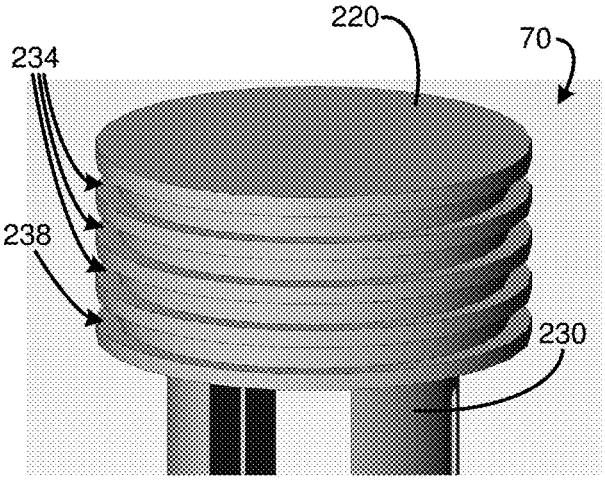
FIG. 32 is an alternate oblique perspective view of the piston assembly in FIG. 31.
Figure 34:
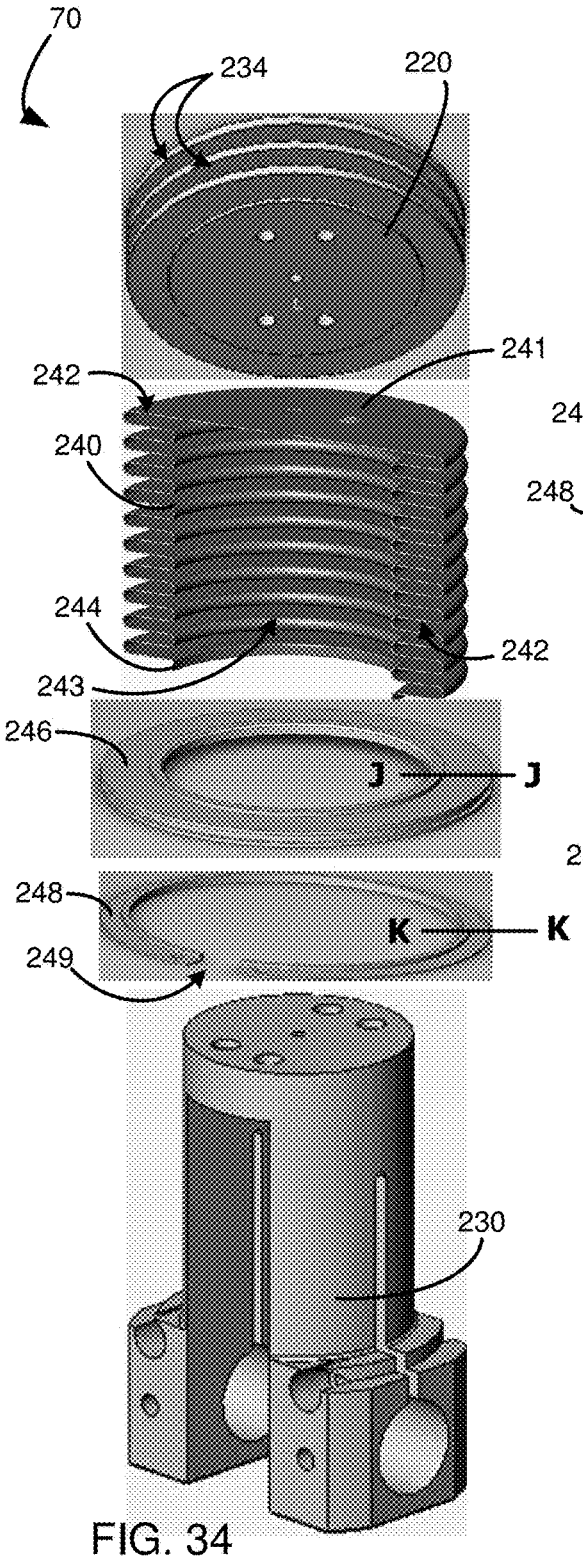
FIG. 34 is an exploded oblique perspective view of the piston assembly in FIG. 33.
Figure 33:
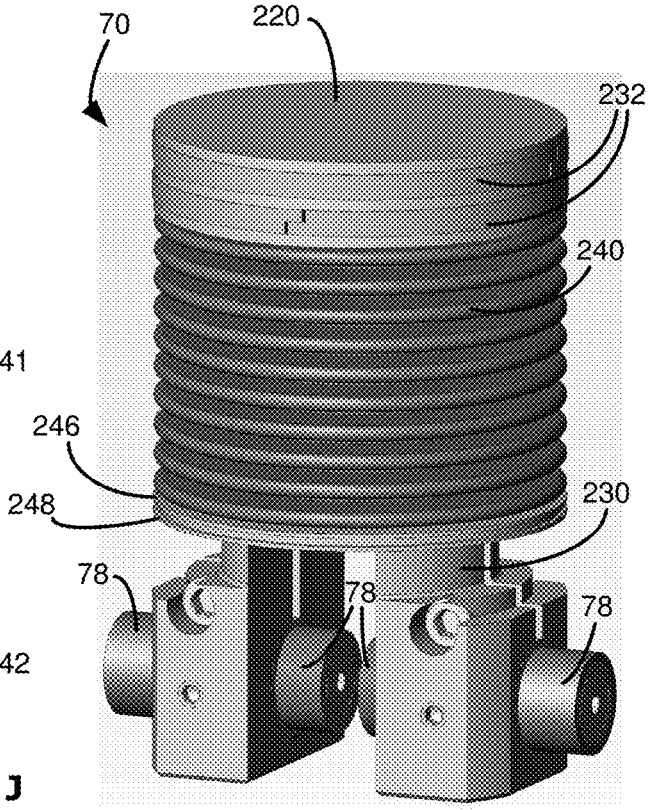
FIG. 33 is an oblique perspective view of an additional alternate exemplary piston assembly for the engine in FIG. 1.
Figure 35:
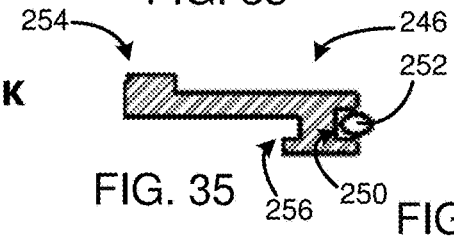
FIG. 35 is a view of the bellows ring in FIG. 34, normal to a cut at line J-J.

Referring now primarily to FIGS. 31 and 32, an alternate exemplary embodiment of a piston assembly 70 may have a piston head 220; one or more oilless ring grooves 234, which in each may be positioned an oilless ring 232; one or more scraper ring grooves 238, which in each may be positioned a scraper ring 236; a piston neck 230; and at least one traveler 78. Since the exemplary piston neck 230 and exemplary travelers 78 function effectively in an oil-rich environment, the exemplary scraper ring 236 may be positioned intermediate the oilless rings 232, and the piston neck 230 and travelers 78. As such, the scraper ring 236 may restrict the movement of oil to the oilless rings 232 and piston head 220, preventing or reducing oil from entering the combustion chamber 72, which is opposite the piston head 220 from the oilless rings 232. One of ordinary skilling in the art would appreciate that oil in the combustion chamber 72 may reduce the combustion efficiency, and foul the spark plugs. Reducing or eliminating oilless ring 232 contact with oil may greatly extend the life of the piston assembly 70, by avoiding or minimizing carbon buildup in the combustion chamber 72 and around the oilless rings 232.

In the exemplary embodiment, the oilless rings 232 may be made of a metal infused with a slide promoting substance. Suitable metals may include stainless steel, steel alloys, brass and other copper alloys, among other potentially suitable metals. Suitable slide promoting substances may also include high-temperature Teflon® and carbon, among other potentially suitable substances. In the exemplary embodiment, the scraper ring 238 may be made of a heat-resistant elastomer. Suitable heat-resistant elastomers may include fluorosilicates and fluorocarbons, among other potentially suitable substances. A potentially suitable fluorocarbon material may be sold under the Viton™ trademark by Dupont Performance Elastomers, LLC, of Wilmington, Del.

Referring now primarily to FIGS. 33 through 37, an additional alternate exemplary embodiment of a piston assembly 70 may have a piston head 220; a piston neck 230; one or more oilless ring grooves 234 within which each may be positioned an oilless ring 232; a bellows 240; and at least one traveler 78. The exemplary bellows 240 may be positioned intermediate the oilless rings 232, and the piston neck 230 and travelers 78, which operate effectively in an oil-rich environment typically found within an engine block 16. The exemplary bellows 240 may have a cylindrically shaped wall 242 that surrounds a bellows interior 243. An end of the bellow 240 may have a bellows head 241 that may contact and seal against the piston head 220 opposite the combustion chamber 72. Opposite the bellows head 241, the exemplary bellows 240 may be open to receive the piston neck 230 into the bellows interior 243, so that the piston neck 230 may be secured to the piston head 220 through the bellows head 241.

The exemplary bellows 240 may also have a bellows ring 246 securely attached to the bellows 240. The exemplary bellows ring 246 may surround the open end of the bellows 240. A bellows ring engagement surface 244 may be welded to the bellow engagement 254 of the bellows ring 246, so as to stay securely connected. The exemplary bellows ring may also have a gasket well 250 around its outer periphery, which may receive a bellows gasket 252. The exemplary bellows ring 246 may be precisely sized to a cylinder 68, and as such, a bellows gasket 252, appropriately supported within a gasket well 250, may provide a desirable seal against the outer wall of a cylinder 68 in which it may be installed. Additionally, the exemplary bellows ring 246 may have a bellows ring retention surface 256.

The exemplary bellows 240 may also have a bellows clamp 248. The exemplary bellows clamp 248 may have a bellows clamp retention surface 258, a cylinder wall engagement lip 260, and a bellows clamp split 249. In the exemplary embodiment, the bellows clamp 248 may have a compressed position where the diameter is reduced, which may include a more closed bellows clamp split 249 position. In such compressed position the bellows clamp 248 may insert into and engage a bellows ring retention surface 256 with the bellows clamp retention surface 258. In a tensioned position the bellows clamp 248 may assume a larger diameter, where the bellows clamp split 249 may assume a more open position. In a tensioned position a bellows clamp 248 and a corresponding bellows ring 246 may be securely connected.

Figure 36:
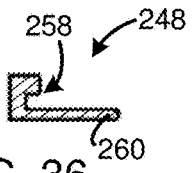
FIG. 36 is a view of the bellows clamp in FIG. 34, normal to a cut at line K-K.
Figure 37:
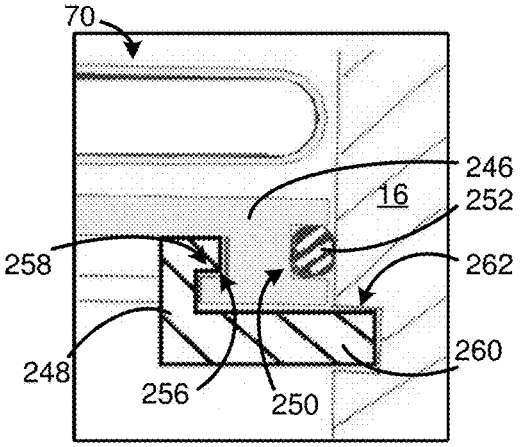
FIG. 37 is detailed view of the bellows clamp in FIG. 34 engaged with a cylinder wall.

In the exemplary embodiment, the bellows clamp 248 may also engage the engine block 16 around the periphery of a corresponding cylinder 68, distal the combustion chamber 72. Referring more specifically to FIGS. 36 and 37, in the exemplary embodiment, a cylinder wall groove 262 may be positioned in the outside wall of a cylinder 68. The exemplary cylinder wall groove 262 may be sized and configured to receive the cylinder wall engagement lip 260 of a bellows clamp 248. In an assembled position the bellows clamp 248 may engage both the corresponding cylinder wall groove 262 and the corresponding bellows ring 246. In that exemplary assembled position, the bellows ring 246 and the corresponding bellows clamp 248 may remain in contact with each other, and the corresponding bellows ring engagement 244 may remain secured to the bellows ring 246 through repeated and continuous cycles of compression and extension of the bellows 240, as the corresponding piston head 220 rises and lowers within the corresponding cylinder 68. In this configuration an exemplary bellows 240, bellows gasket 252, and cylinder wall engagement lip 260 may effectively restrict the movement of oil and combustion materials between a combustion chamber 72 and an oil-rich environment within the engine block 16. Structural voids proximate to the travelers 78 may be such an oil-rich environment.

It may be appreciated that restricted, reduced, and eliminated movement, or migration, of oil to the oilless rings 232 and piston head 220 may prevent or reduce oil from entering the combustion chamber 72, and that oil entering the combustion chamber 72 may reduce the combustion efficiency and foul the spark plugs. Reducing or eliminating oilless ring 232 contact with oil may greatly extend the life of the piston assembly 70, by avoiding or minimizing carbon buildup in the combustion chamber 72 and around the oilless rings 232. Additionally, it may be appreciated that restricted, reduced, and eliminated movement or migration of combustion materials, such as fuel and exhaust elements, may preserve and extend the integrity and performance of an operating engine's oil, which may extend the life of an engine 10.

Figure 38:
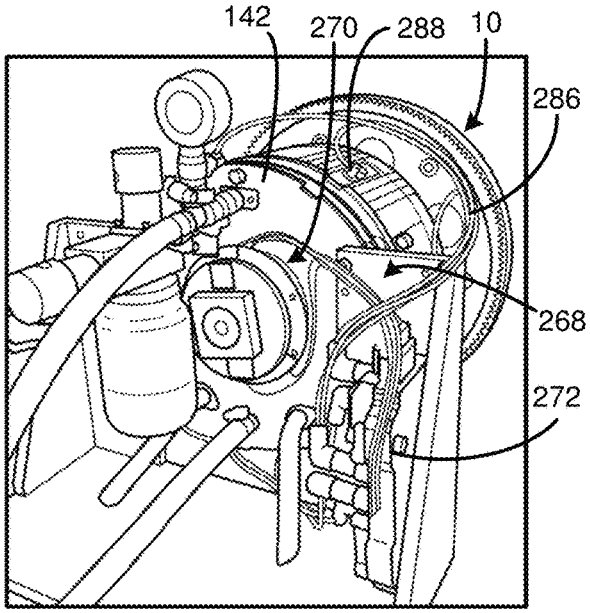
FIG. 38 is an oblique perspective view of an exemplary ignition system mounted on the rear of the engine in FIG. 1.
Figure 39:
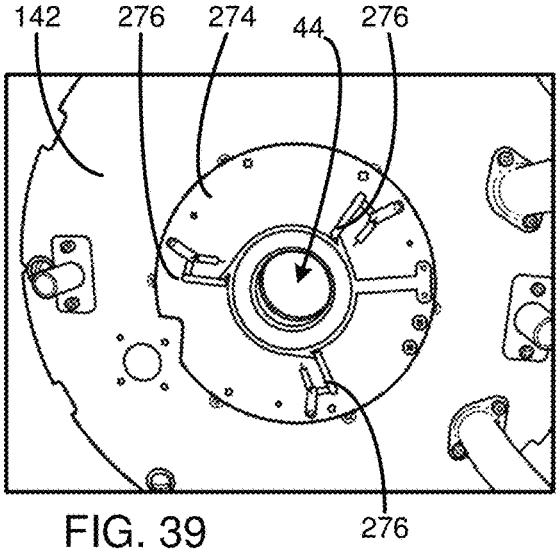
FIG. 39 is an oblique perspective view of an exemplary stator for the ignition system in FIG. 38.
Figure 40:
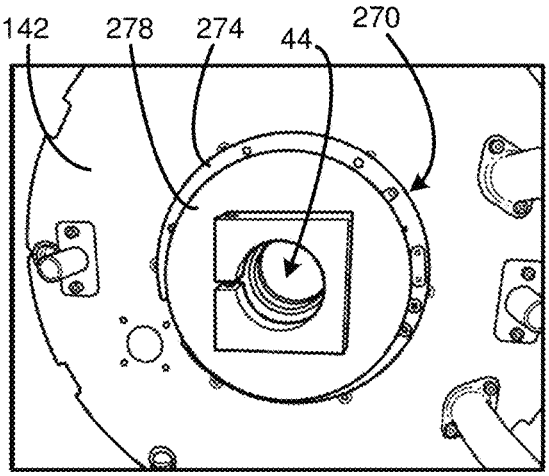
FIG. 40 is an oblique perspective view of the rear of an exemplary rotor for the ignition system in FIG. 38.
Figure 41:
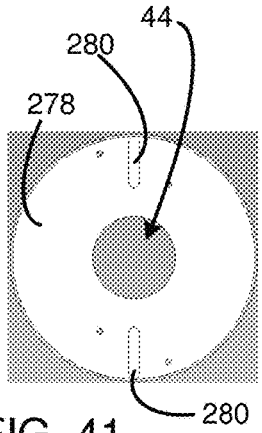
FIG. 41 is a normal view illustration of the front of the exemplary rotor in FIG. 40.
Figure 42:
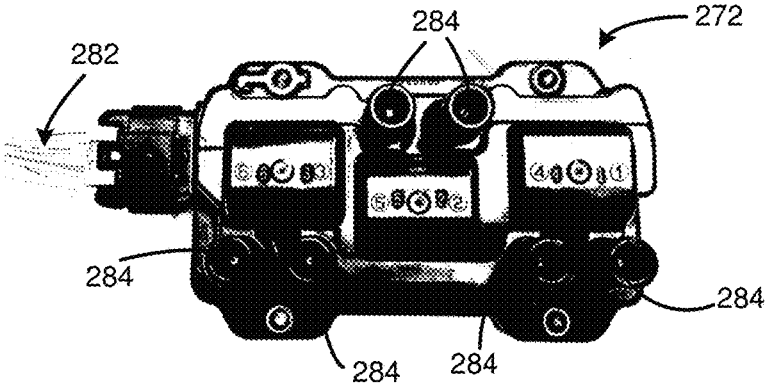
FIG. 42 is an oblique perspective view of an exemplary integrated coil for the ignition system in FIG. 38.

Referring now primarily to FIGS. 38 and 42, an exemplary ignition system 268 may include a trigger assembly 270, an integrated coil 272, and a set of spark plug wires 286. In the exemplary embodiment, the trigger assembly 270 may include a stator 274 and a rotor 278. The stator 274 and rotor 278 may each have a flat disk shape, with a shaft hole 44. In the exemplary embodiment, the rotor 278 may be attached to the shaft 22, perpendicular to the shaft 22, so as to rotate simultaneously with the shaft 22. In the exemplary embodiment, the stator 274 may be attached to the rear plate 142, perpendicular to the shaft 22, to remain rotatably stationary to the rear plate 142. The flat disk shape permits the stator 274 and rotor 278 to be positioned parallel to each other and near each other, and permit rotation of either the stator 274 or the rotor 278 without making contact with each other.

The exemplary stator 274 may have at least one trigger 276, with an open position, where electrical contact across the trigger 276 does not occur, and a closed position, where electrical contact across the trigger does occur. In the exemplary embodiment, the trigger 276 is moved from the open position to the closed position by being brought into a magnetic field. The exemplary rotor 278 may have at least one magnet 280 that may produce an appropriate magnetic field to effect movement in the trigger 276 between the open and closed positions. In the exemplary embodiment, the trigger 276 in the closed position may communicate an electrical signal to the integrated coil 272 through a control wire 282. The exemplary integrated coil 272 may create an electrical charge in response to such communication, and transmit the charge to a particular spark plug wire contact 284, which in turn would communicate the charge through the spark plug wires 286 to a particular spark plug 288, to ignite combustion in a particular combustion cylinder 68.

The exemplary ignition system 268 may be configured to induce two electrical charges per rotation of the rotor 278. In the exemplary embodiment, the integrated coil 272 may be configured so that one signal from a trigger 276 causes a charge to be communicated to two spark plug wire contacts 284, and therefore two cylinders 68, at the same time. Such an embodiment could require half as many triggers 276 cylinders 68 in the engine 10. Additionally, in the exemplary embodiment, the rotor 278 may have two magnets 280 positioned precisely opposite each other circumferentially on the rotor 278. Such an embodiment could move each trigger 276 from an open position to a closed position twice in each complete rotation of the rotor 278, resulting in one trigger 276 sending two signals to the integrated coil 272 for one rotation of the rotor 278. Such an engine 10 configuration may have half as many triggers 276 as cylinders 68. Such an engine 10 configuration may create two combustions per cylinder 68 per revolution of the shaft 22.

Applying the ignition system 268 configuration, where one signal from a trigger 276 causes a charge to be communicated to two spark plug wire contacts 284, to the exemplary engine 10 in FIG. 8*a*, may create neutral lateral forces on shaft 22 by coordinating the resulting simultaneous combustions in opposing cylinders 68. (In this disclosure, "lateral forces" is being used to mean any forces on the shaft 22 other than the desired rotational forces about the axis on which the shaft 22 intentionally turns.) In such an exemplary embodiment, forces, other than rotational, will occur in opposite pairs, and therefore offset. As seen in FIG. 8*a*, opposing piston assembly 70 may be coordinated to operate in the exact same cycle pattern, thereby precisely coordinating the simultaneous operation of opposing cylinders 68, and balancing lateral forces, created by combustion, on shaft 22.

Figure 43A:
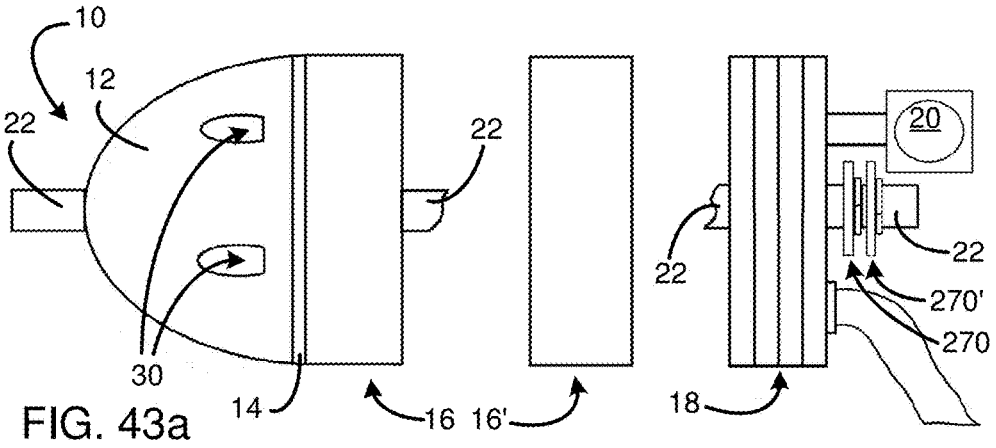
FIG. 43*a* a schematic illustration of an expanded modular engine with a supplemental engine block.

Referring now primarily to FIG. 43*a*, an exemplary engine 10 is shown in a partially exploded view in order to illustrate how the engine 10 may be expanded in size by adding an additional bank of cylinders 68. As previously shown, engine 10 may comprise a bell housing 12, a thrust bearing plate 14, and a first engine block 16, all mounted on a shaft 22. The modular design of the exemplary embodiment permits the addition of a supplemental engine bank 16'. In the exemplary embodiment, the supplemental engine bank 16' may be inserted intermediate the first engine bank 16 and a manifold assembly 18. In the exemplary embodiment, each engine bank (16, 16') may have a corresponding ignition trigger assembly (270, 270').

Figure 43B:
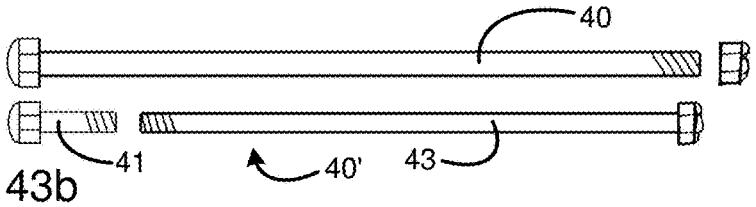
FIG. 43*b* is a schematic illustration of an engine bolt and an alternate embodiment engine bolt.

Referring also now to FIG. 43*b*, the initial embodiment of exemplary engine bolts 40 are shown to be a single shaft adequate in length to extend through from the bell housing 12 through the manifold assembly 18. An alternate exemplary embodiment may include a 2-piece bolt assembly 40', comprised of an initial securement bolt 41, and a rear bolt 43. In the exemplary embodiment, the initial securement bolt 41 secures the bell housing 12 to the thrust bearing plate 14 and the first engine block 16, and anchors into the engine block 16. In this embodiment, the initial securement bolt 41 may be threaded to be received by corresponding threads within the assembly bolt channel 30 of the first engine block 16. Rear bolt 43 may be inserted from the rear of the engine 10, securing the manifold assembly 18, and any supplemental engine blocks 16', to the first engine block 16. Similarly to the initial securement bolt 41, rear bolt 43 may be threaded to be received by corresponding threads within the assembly bolt channel 30 of the first engine block 16. 2-piece bolt assembly 40' may more appropriately provide for the modular expansion of engine 10 by reusing the initial securement bolt 41 when supplemental engine blocks 16' are added to engine, the initial rear bolt 43 may be replaced with one of adequate length to support the additional engine 10 length created by the additional width of the supplemental engine block 16'.

Figure 44:
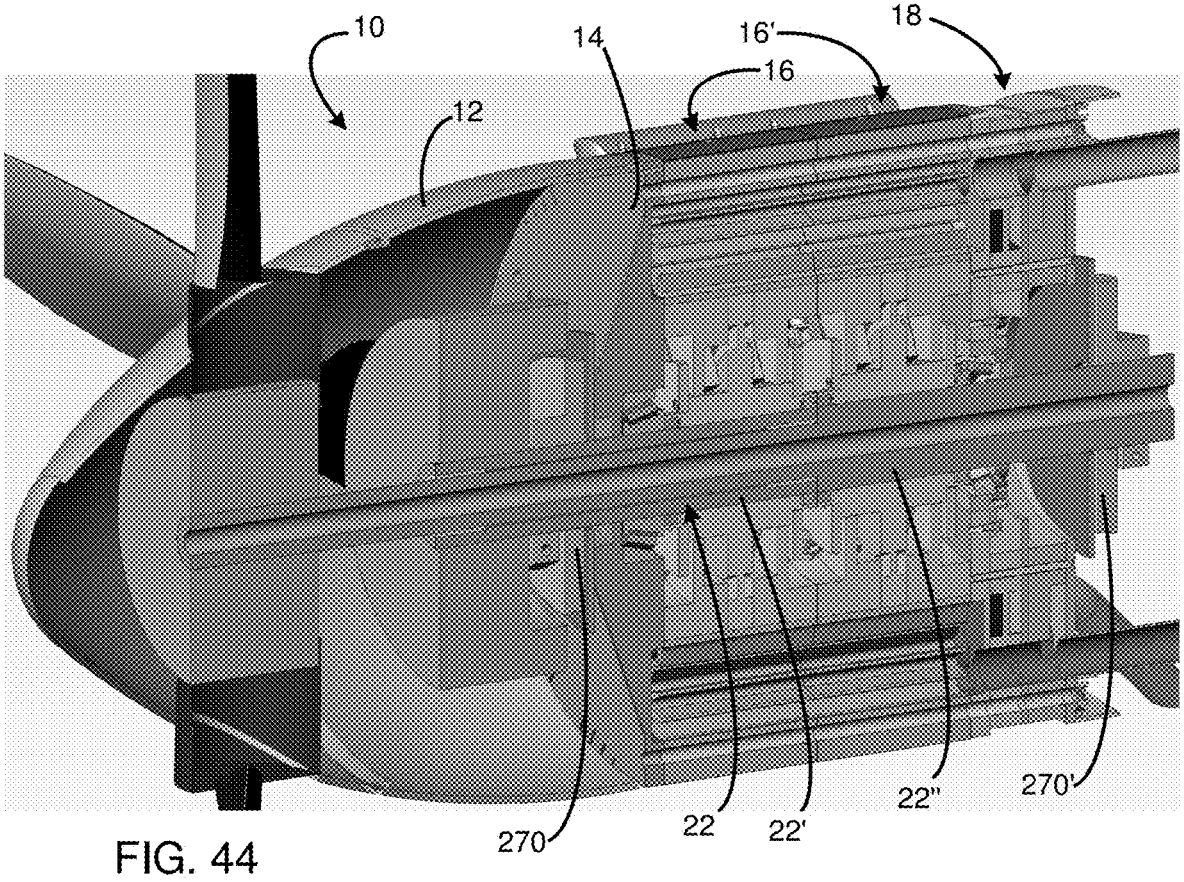
FIG. 44 is a side view of an alternate exemplary embodiment of engine according to the present invention cut through the shaft axis.

Referring now primarily to FIG. 44, an alternate exemplary engine 10 is shown in a side view, cut-away through the shaft 22 axis in order to illustrate how the engine 10 may be configures with a supplemental engine block 16' configured to be rotate counter to the original engine block 16. As previously shown, engine 10 may comprise a bell housing 12, a thrust bearing plate 14, and a first engine block 16, a supplemental engine block 16', all mounted on a shaft 22.

In the exemplary embodiment, shaft 22 may have a first shaft segment 22' and a second shaft segment 22". In the exemplary embodiment, first shaft segment 22' and a second shaft segment 22" may be coaxial, and first shaft segment 22' may be assembled to surround a portion of the second shaft segment 22". In the exemplary embodiment, the first engine block 16 may be securable to the first shaft segment 22', and a corresponding ignition trigger assembly 270 may also be attached to the first shaft segment 22'. In the exemplary embodiment, a supplemental engine block 16' may be securable to a second shaft segment 22", and a corresponding ignition trigger assembly 270' may also be attached to the second shaft segment 22". In this configuration, the first engine block 16 may power the rotation of the first shaft segment 22' in one direction, with the ignition timing controlled by the first ignition trigger assembly 270, while the second engine block 16' may power the rotation of the second shaft segment 22" in the opposite direction, with the ignition timing of the second engine block 16' controlled by the second ignition trigger assembly 270'.

In the shaft 22, the first shaft segment 22' and a second shaft segment 22" may be selectively linkable. In the event that one engine block (16, 16') may fail, or be shut-down to conserve fuel, it may be advantageous to have a selectable linkage to power both the first shaft segment 22' and a second shaft segment 22", even if the two segments may be configured to rotate in opposite directions.

Figure 45:
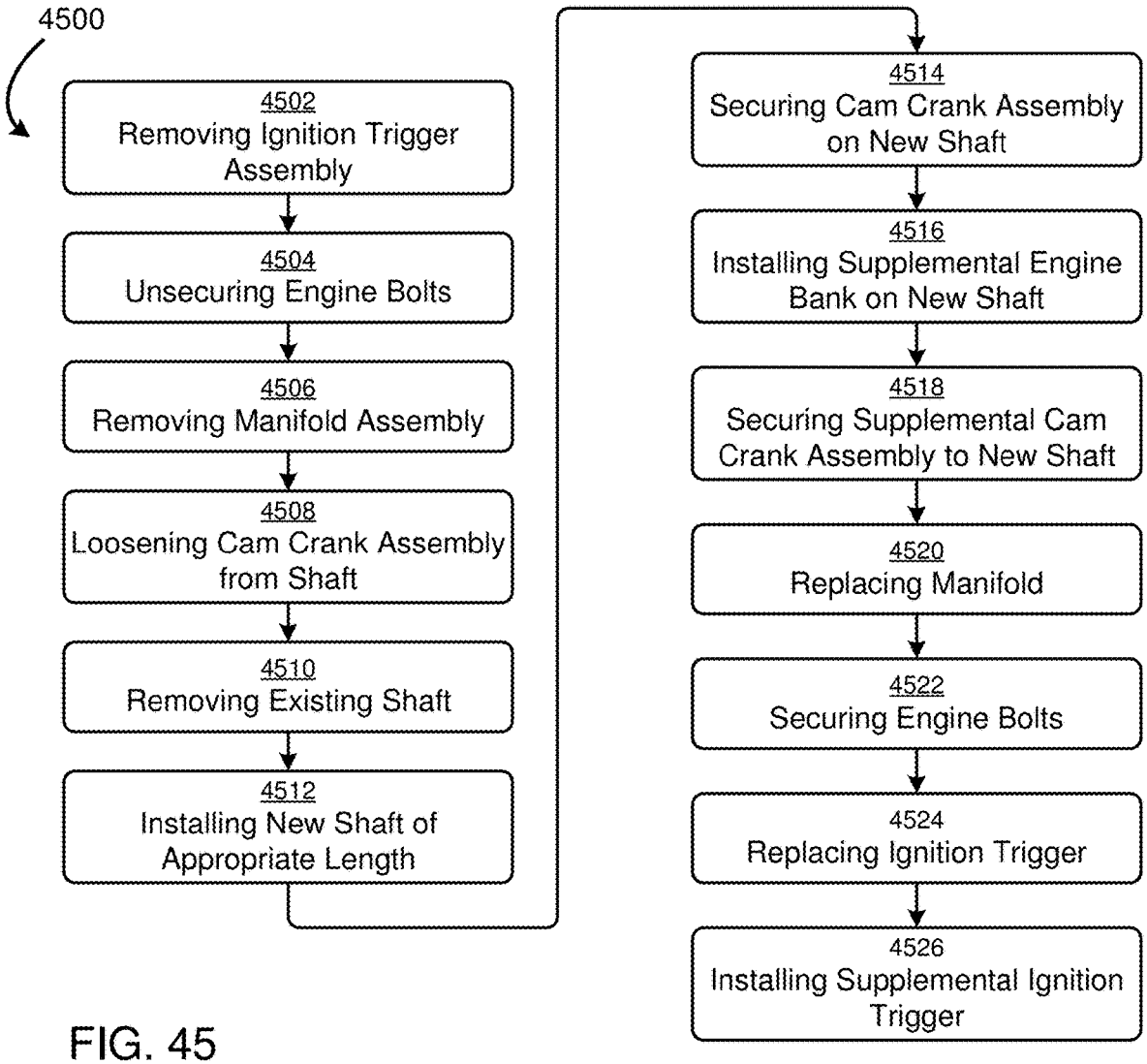
FIG. 45 is a flow diagram of an exemplary process for adding a supplemental engine block to an engine.

Referring now primarily to FIG. 45, an exemplary process for modularly expanding 4500 the engine 10 is shown to possibly consist of removing 4502 the existing ignition trigger assembly 250 from the rear of the shaft 22. This may allow for unsecuring 4504 the assembly bolts 40, which will permit removing 4506 the manifold assembly 18. In the exemplary embodiment, the initial shaft 22 is of proper length for an engine 10 with one (1) engine block 16. In order to accommodate the width of an additional engine block 16, a longer shaft 22 may be necessary. Removing 4510 the existing shaft 22 may be accomplished by loosening 4508 the cam crank assembly 75 from the shaft 22. In the exemplary embodiment loosening 4508 the cam crank assembly 75 may include loosening a plurality of securing bolts 94, which in turn will permit the tapered bushings 95 to reduce their impinging force applied to the shaft 22. The shaft 22 may then be removed from the engine 10 by sliding it along the shaft's 22 rotation axis. It can be appreciated that, in the exemplary embodiment, if the engine 10 to be expanded initially has more than one (1) engine block 16, each engine block 16 may be removed in sequence, from the rear of the engine 10, through repeated loosenings 4508 of each particular cam crank assembly 75.

With the existing shaft 22 removed, installing 4512 a new shaft 22 of appropriate length for the desired new engine 10 configuration may be accomplished. The new shaft 22 may be secured within the engine 10 by securing 4514 the original cam crank assembly 75 to the shaft 22 by tightening the securing bolts 94 against the tapered bushings 95, causing the tapered bushings 95 to impinge against the shaft 22.

With the new shaft 22 secured in the original engine block 16, installing 4516 a supplemental engine block 16' may be accomplished. Securing 4518 the supplemental engine block 16' on the new shaft may be accomplished in the same manner as securing 4514 the cam crank assembly 75 of the original engine block 16. In the exemplary embodiment, each engine block 16 or supplemental engine block 16' may be secured to the shaft 22 in the same manner—by securing (4514, 4518) a respective cam crank assembly 75 to the shaft 22.

With the supplemental engine blocks 16' secured on the shaft 22, replacing 4520 the manifold assembly 18 may be appropriate. The supplemented engine 10, with a new engine block 16 configuration, may then be unified by securing 4522 the engine bolts 40.

In the exemplary embodiment, a particular ignition triggers assembly 270 is used to time the firing sequence for a respective engine bank (16, 16'). In the exemplary embodiment, the ignition trigger assembly 270 for the original engine bank 16 comes first in order from the front to the rear of the engine 10, but the order needs not be critical, as long as the radial position of the ignition trigger assembly 270 is appropriate for the respective engine bank 16. In the exemplary embodiment, each engine block (16, 16') align so that the cylinders from one engine block 16 radially align with cylinders from the supplemental engine block 16'. The differential in firing sequence is achieved by changing the radial positioning of the triggers 276 around the shaft 22 for each ignition trigger assembly 270.

In the exemplary embodiment, to keep the original ignition trigger assembly 270 in physical order with the original engine bank 16, replacing 4524 the original ignition trigger 270 may be accomplished before installing 4526 any supplemental ignition triggers 270'.

With a shaft 22 of appropriate length, additional engine blocks 16' may be added to the engine 10. Exemplary manifold assembly 18 is configured to support multiple engine blocks 16. Additionally, each exemplary engine block 16 may incorporate intake channels 80 and exhaust channels 82 to support the additional modular engine blocks 16' that the engine 10 may be able to possess.

Variations in the radial engine design may follow some suggestions for achieving favorable results. Pairs of opposing cylinders 68 may be sequenced to operate at identical combustion cycles by tuning the cam crank 74, intake cam 90, exhaust cam 92, and ignition system 268. The position of the cylinders 68 may be arranged in banks, each bank comprising a single engine block 16 and all the functional components contained therein, around the shaft 22. It is suggested to space the cylinders 68 evenly within each particular engine bank 16. For a balanced radial engine, determine the angle that achieves even spacing between the centerline of each cylinder in a bank divide 180 by one half the number of desired cylinders 68. This will provide the spacing of half of the cylinders in half of the bank. Position the other half of the cylinders precisely opposed to the first half of the cylinders.

When adding an additional bank of cylinders 68 to and engine 10, it is suggested that similarly sized engine blocks 16 be used, in order to provide consistent balance of the forces combustion within the cylinders 68 will apply to the engine 10. It is also suggested to offset the angle of firing the cylinders 68 in each bank of cylinders 68, so as to provide even power application throughout the rotational cycle of the shaft 22. The amount of the suggested offset of the firing sequence may be one half the spacing between the centerline of each cylinder 68 in the initial bank of cylinders 68. It is suggested that it may be desirable when adding additional engine blocks 16 to an engine 10, to adjust the firing of engine 10 as a whole to achieve even spacing of the firing sequences within the engine 10.

Though the radial spacing of the cylinders 16 within a bank of cylinders 68 is determined at the formation of the corresponding engine block 16, the modular nature of the current design enables an existing engine 10 to be supplemented with additional banks, by adding additional engine blocks 16. The angle of the firing sequence of a particular bank of cylinders 68 may be adjusted radially around the center shaft 22 to achieve a desirable radial cylinder 68 firing within the supplemented engine 10, and thereby desired power application to the shaft 22.

Figure 46A:
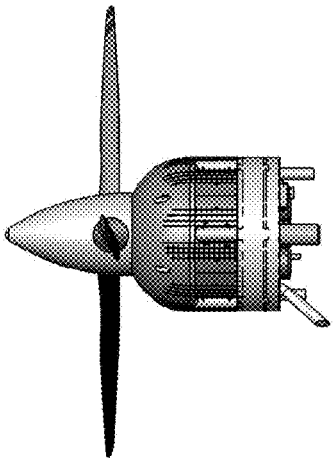
FIGS. 46*a* through 46*v* are illustrations of configurations of various exemplary embodiments of the modular engine according to the present invention.
Figure 46B:
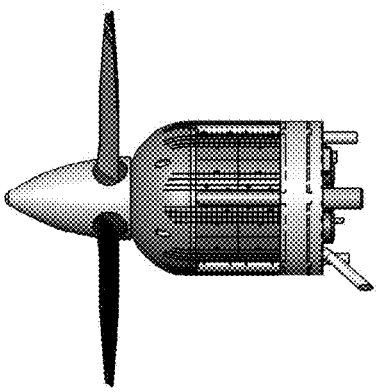
Figure 46C:
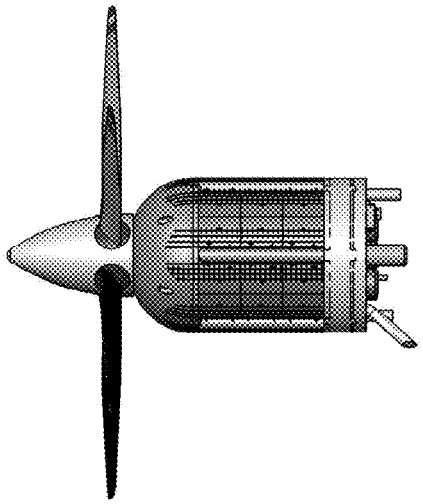
Figure 46D:
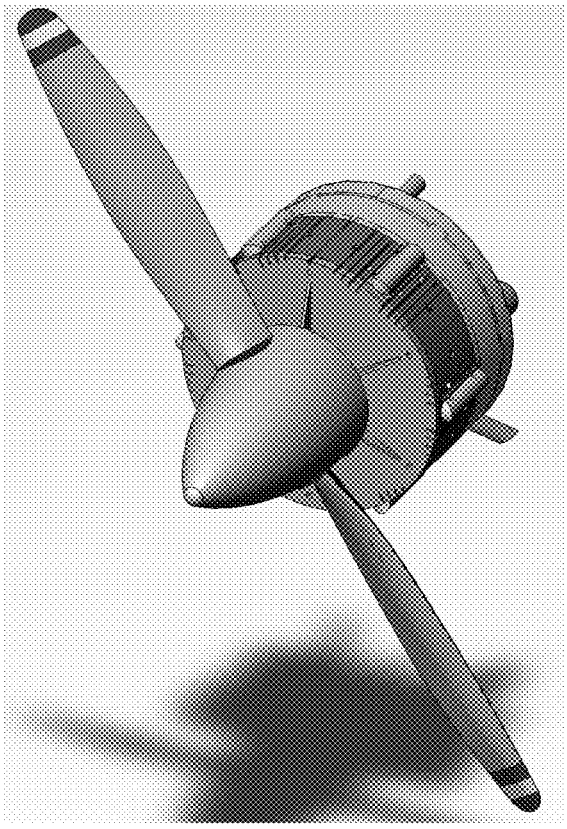
Figure 46E:
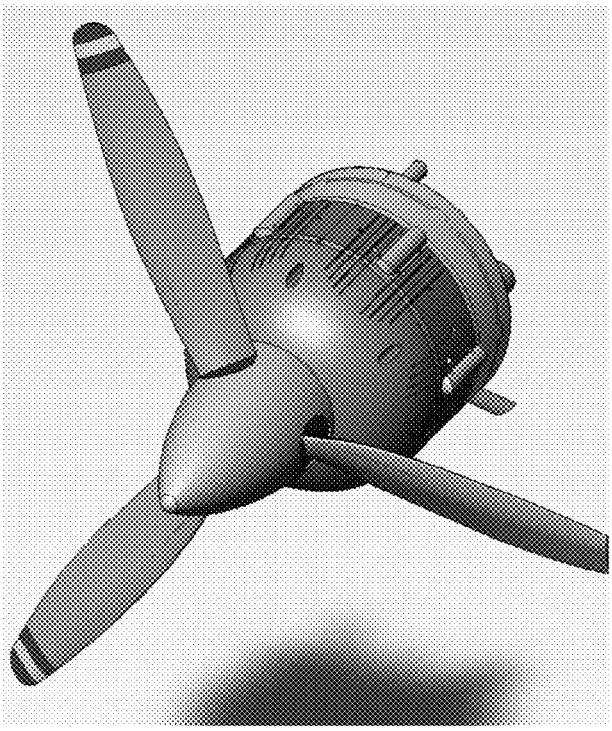
Figure 46F:
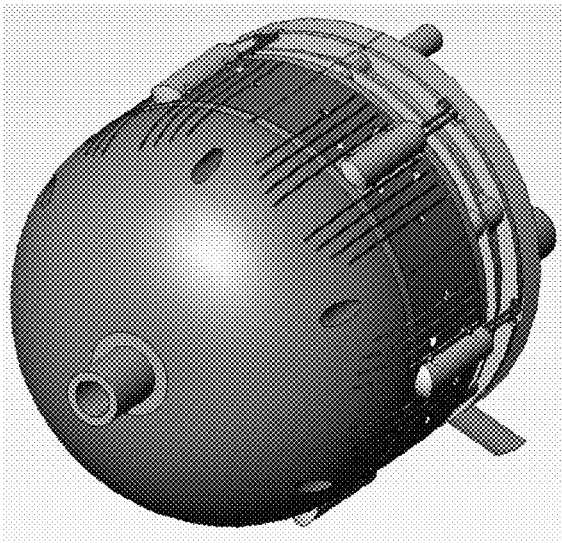
Figure 46G:
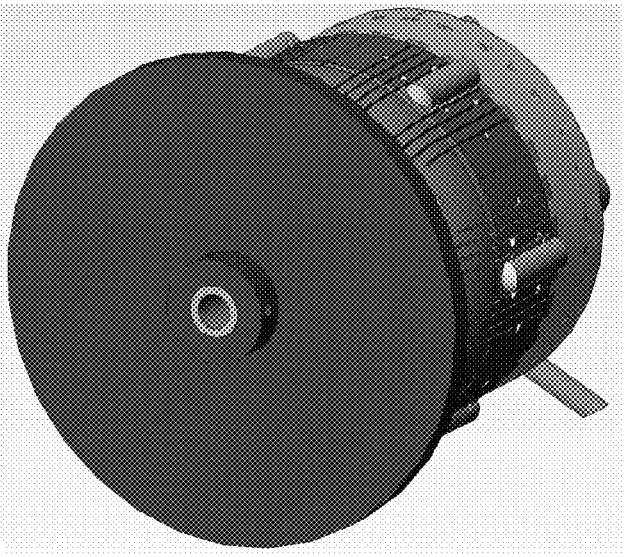
Figure 46H:
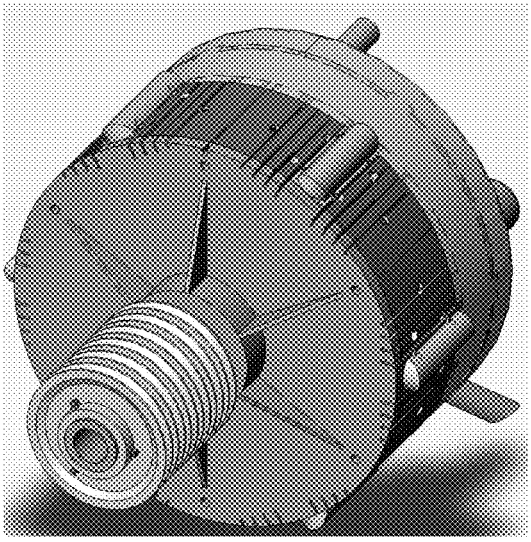
Figure 46I:
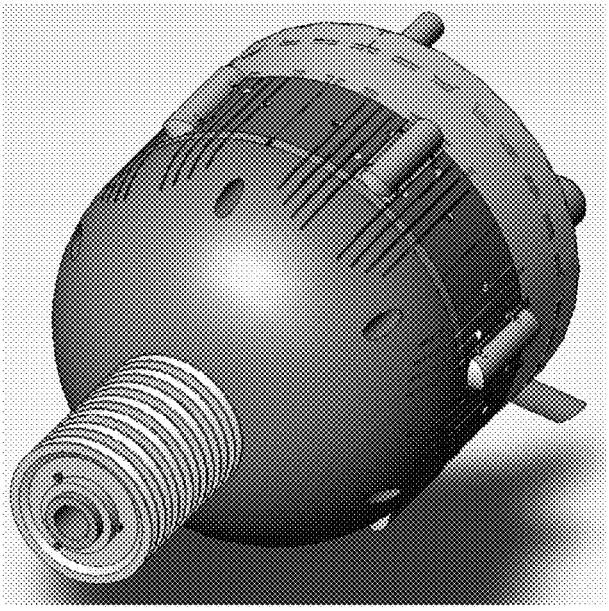
Figure 46J:
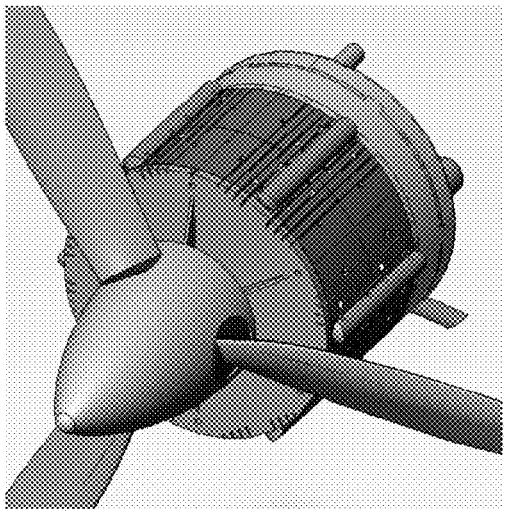
Figure 46K:
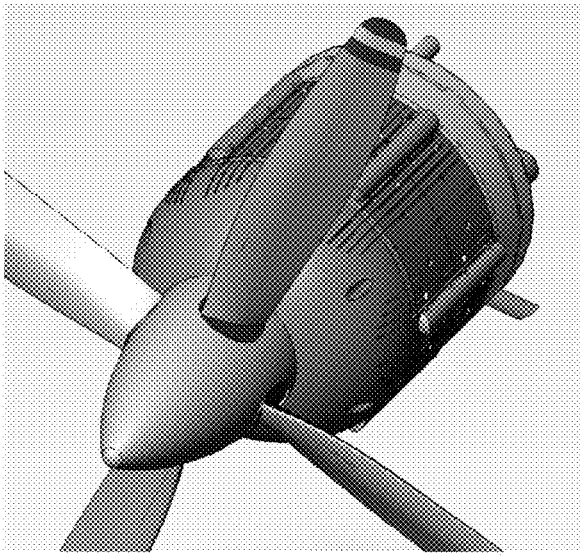
Figure 46L:
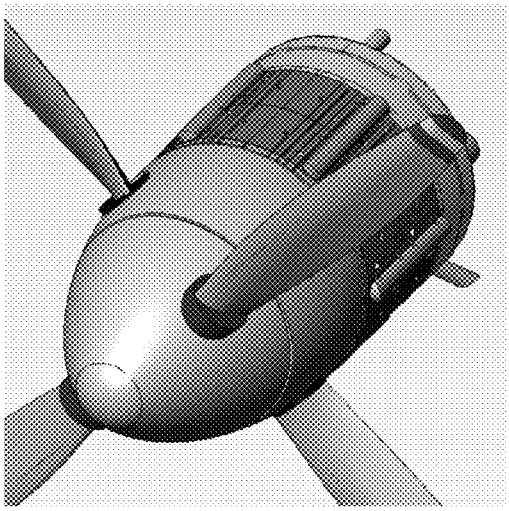
Figure 46M:
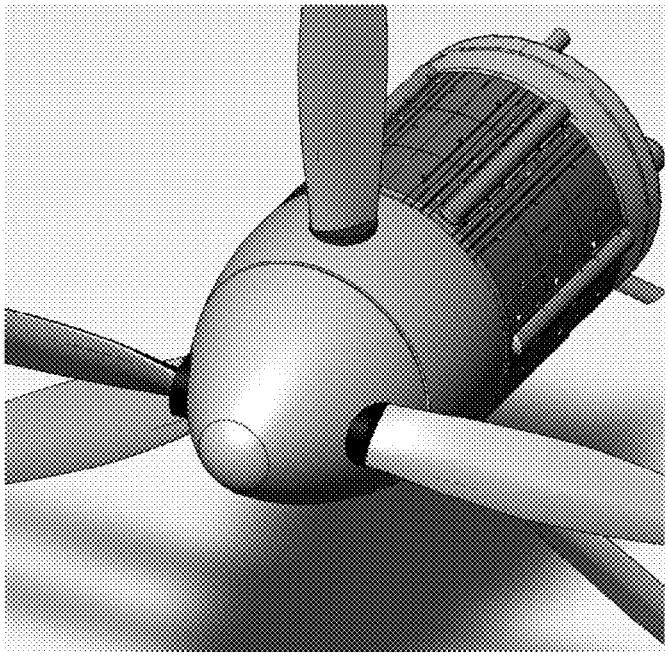
Figure 46N:
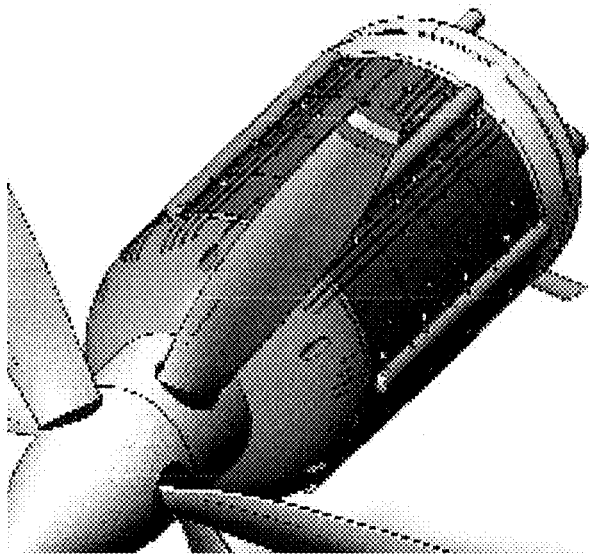
Figure 46O:
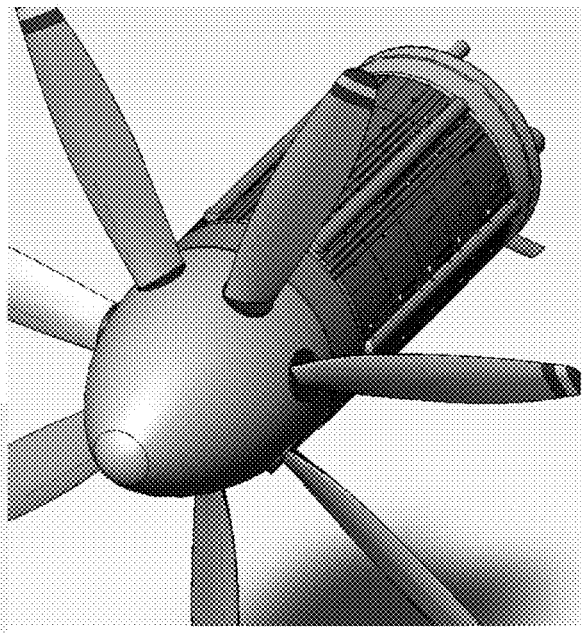
Figure 46P:
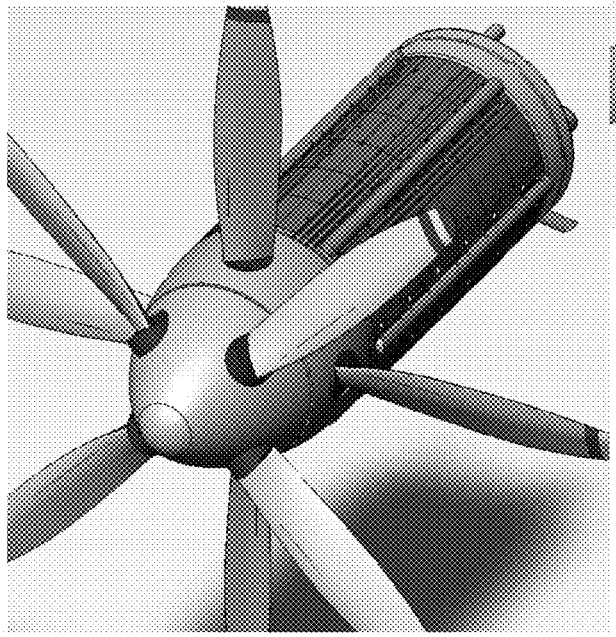
Figure 46Q:
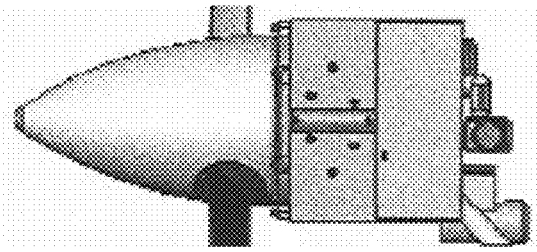
Figure 46R:
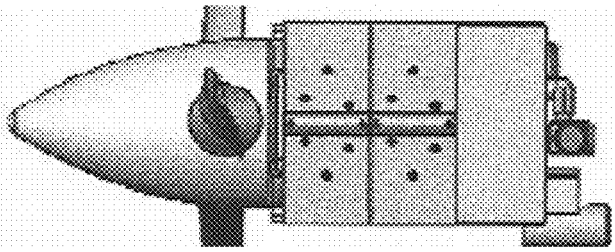
Figure 46S:
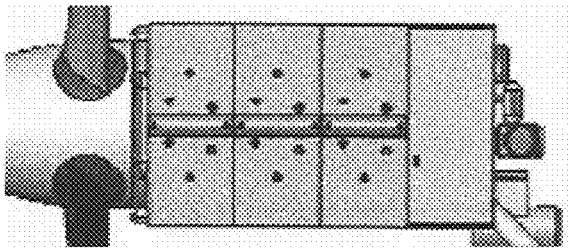
Figure 46T:
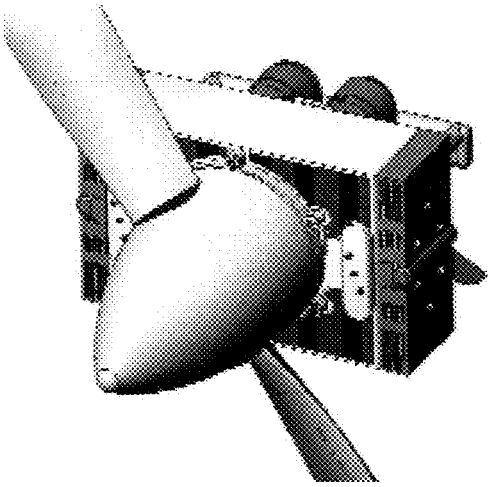
Figure 46U:
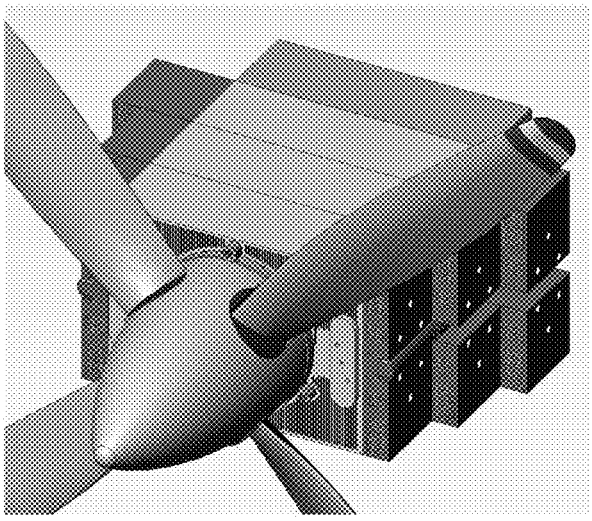
Figure 46V:
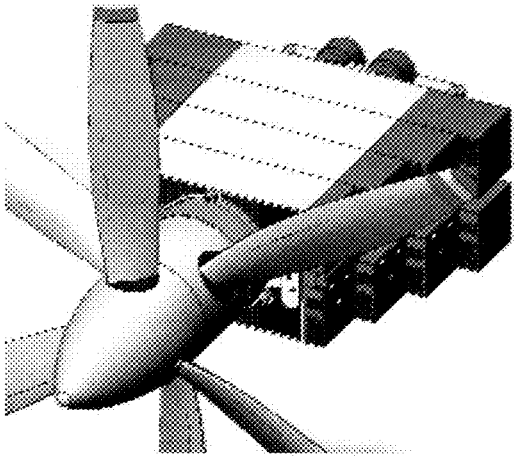

Referring now primarily to FIGS. 46*a* through 46*v*, various engine configurations are shown. The configurations may vary in a number of ways, including the number of banks of cylinders 68, the configuration of the cylinders 68, such as radial or opposed, and the propeller blade configurations. Propellers may vary in number, in number of banks, and in the counter-rotation of banks of propellers. Additionally, because of the configuration of the current design, a specific bank of propellers may be driven by a particular engine bank, or set of engine banks. Additionally, the drive shaft may be configured to have multiple coaxial drive shafts connecting a particular propeller bank to a particular engine bank. Further, a particular propeller bank may rotate opposite to another propeller bank (counter-rotate) in the same engine 10, since the coaxial connection between distinct engine banks may support such counter-rotation.

FIGS. 46*a* through 46*c* show a side-by-side comparison of an exemplary engine in a radial configuration, with one engine bank, two engine banks, and three engine banks, respectively. FIG. 46*d* shows a single-engine-bank engine configured as a direct drive power source to a propeller set. FIG. 46*e* shows a single-engine-bank engine configured with a bell housing 12, in which a set of reduction gearing may be housed intermediate the engine 10 and a propeller set.

FIG. 46*f* shows a single-engine-bank engine configured as with a bell housing 12, in which a set of reduction gearing may be housed. FIG. 46*g* shows a single-engine-bank engine configured as with a flywheel. Such a configuration may permit the engine bank 16 to comprise a single cylinder 68, since the flywheel may carry the combustion cycle over inflection points in the power generation cycle. FIG. 46*h* shows a single-engine-bank engine configured as with a drive pulley output for the transmission of power from the engine to operate machinery. FIG. 46*i* shows a single-engine-bank engine configured as with a drive pulley output, and configured with a bell housing 12, in which a set of reduction gearing may be housed intermediate the engine 10 and a pulley.

FIG. 46*j* shows a dual-engine-bank engine configured as a direct drive power source to a propeller set. FIG. 46*k* shows a single-engine-bank engine configured with a bell housing 12, in which a set of reduction gearing may be housed intermediate the engine 10 and a propeller set. FIG. 46*l* shows a dual-engine-bank engine configured with two propeller sets. The illustrated propeller sets are configured to counter-rotate. This can be accomplished by coaxial shafts directly linking a particular engine bank (16, 16') to a particular propeller. For counter-rotation, the respective engine banks may be configured to rotate in opposite directions. Similarly, the propeller sets could be configured to rotate the same direction. This may still employ coaxial shafts 22, but the engine blocks could operate in the same rotational direction.

FIG. 46*m* shows a triple-engine-bank engine configured with two propeller sets. The illustrated propeller sets are configured to counter-rotate. FIG. 46*n* shows a quadruple-engine-bank engine configured with two propeller sets. The illustrated propeller sets are configured to rotate in the same direction. FIG. 46*o* shows a quintuple-engine-bank engine configured with a single propeller set. FIG. 46*p* shows a sextuple-engine-bank engine configured with two counter-rotational propeller sets.

FIG. 46*q* through 46*s* show a side-by-side comparison of an exemplary engine in an opposed configuration, with one engine bank, two engine banks, and three engine banks, respectively, with housings over the manifold assemblies 18. FIG. 46*t* shows a single-engine-bank opposed engine configured as a direct drive power source to a propeller set. FIG. 46*u* shows a triple-engine-bank opposed engine, with a housing over the manifold assembly 18, configured as a direct drive power source to a propeller set. FIG. 46*v* shows a quadruple-engine-bank opposed engine with two sets of propellers, configured to rotate in the same direction. This exemplary embodiment is shown with room for a reduction gear set intermediate the first engine block 16 and the propeller sets.

Envisioned claims include a modular internal combustion engine that may comprise at least one engine block, where said at least one engine block may comprise at least one cylinder and a crank shaft, the at least one cylinder having a piston and a combustion chamber, a cam crank connected to the crank shaft, the cam crank having a cam crank profile, the at least one piston operationally connected to the cam crank profile, an intake cam and an exhaust cam linked to the crank shaft, and an integrated manifold system supporting fluid communication through an intake channel to the engine block, and through an exhaust channel.

There are a number of variations and additions that may be claimed, including that said at least one engine block comprising at least a pair of opposed cylinders; that the internal combustion engine may comprise multiple pairs of radially opposed cylinders. The internal combustion engine may further comprise the cam crank profile being a contoured radial channel in at least one side of the cam crank. The internal combustion engine may further comprise the cam crank profile controlling a position of a piston with respect to a combustion chamber. The internal combustion engine may further comprise the intake cam, the exhaust cam, and the cam crank each having a disk shape with a centrally located shaft hole; and a cam crank assembly comprising the intake cam, the exhaust cam, and the cam crank positioned parallel to each other, coaxially through each shaft hole, and the cam crank intermediate the intake cam and the exhaust cam. The internal combustion engine may further comprise the cam crank having center and an outer edge; the cam crank profile having at least one radial lobe; the radial lobe having a bottom section close to the cam crank center and a top section close to the cam crank outer edge; the at least one piston in a bottom position within the cylinder when operationally connected to the radial lobe bottom section; and the at least one piston in a top position within the cylinder when operationally connected to the radial lobe top section. Additionally, the internal combustion engine may further comprise the radial lobe having an upward intermediate section rotationally intermediate from bottom section to the top section, and a downward intermediate section rotationally intermediate from the top section to the bottom section; the at least one cylinder having an intake valve and an exhaust valve; and a compression stroke characterized by the intake and exhaust valves each in a closed position, and the at least one piston operationally connected to the radial lobe upward intermediate section. Additionally, the internal combustion engine may further comprise more than one compression stroke per complete revolution of the crank shaft.

Other variations may include that the internal combustion engine further comprises said crank shaft having an external shaft and a coaxial internal shaft; the external shaft and the internal shaft selectively independently rotatable; and a first engine block operatively attachable to the external shaft and a second engine block operationally attachable to the internal shaft. The first engine block may be operatively configured to rotate the external shaft in a rotational direction, and the second engine block operatively configured to rotate the internal shaft in the same rotational direction. Then, said crank shaft may have a first rotational direction and an opposite rotational direction; and the first engine block operatively configured to rotate the external shaft in the first rotational direction, and the second engine block operatively configured to rotate the internal shaft in the opposite rotational direction.

A process, with a number of possible variations, is also envisioned, such as a process for expanding a modular engine, the modular engine having a manifold assembly, an existing engine bank, and an existing cam crank assembly attached to an existing shaft, where the process comprises removing the manifold assembly, loosening the existing cam crank assembly from the existing shaft, removing the existing shaft from the modular engine, installing a longer shaft, installing a first cam crank assembly on the longer shaft, securing the longer shaft to the existing engine bank with a first cam crank assembly, installing a supplemental engine bank on the longer shaft, installing a supplemental cam crank assembly on the longer shaft, securing the supplemental engine bank to the longer shaft with the supplemental cam crank assembly, and replacing the manifold assembly. The existing cam crank may be used as the first cam crank, but a new cam crank may be desired.

Variations of the process may include that each engine bank having an operational timing; each cam crank having a rotational position on the longer shaft; setting the operational timing of the existing engine bank with the rotational position of the first cam crank on the longer shaft; setting the operational timing of the supplemental engine bank with the rotational position of the supplemental cam crank on the longer shaft; and adjusting the radial angle between the rotational positions of the first cam crank and the supplemental cam crank to coordinate the operational timing of the exiting engine bank and the supplemental engine bank. The modular engine having an existing ignition trigger assembly may further comprise removing existing ignition trigger assembly from the existing shaft before removing the manifold assembly, and installing a first ignition trigger assembly on the longer shaft after replacing the manifold assembly. The process may include that the longer shaft comprises an external shaft and an internal shaft, the external shaft and the internal shaft independently rotatable; securing the existing engine bank to the external shaft; and securing the supplemental engine bank to the internal shaft. The process that includes the modular engine having an existing ignition trigger assembly may further comprise removing the existing ignition trigger assembly from the existing shaft before removing the manifold assembly, the longer shaft comprises an external shaft and an internal shaft, the external shaft and the internal shaft independently rotatable, installing a first ignition trigger assembly on the external shaft after replacing the manifold assembly, and installing a second ignition trigger assembly on the internal shaft.

As with the cam crank, the existing ignition trigger may be reused, but a new, first ignition trigger may be use instead. The existing ignition trigger also could be used as the second ignition trigger, if such reuse is desired.

The examples contained in this specification are merely possible implementations of the current system, and alternatives to the particular features, elements and process steps, including scope and sequence of the steps may be changed without departing from the spirit of the invention. The present invention should only be limited by the examined and allowed claims, and their legal equivalents, since the provided exemplary embodiments are only examples of how the invention may be employed, and are not exhaustive.

I claim:

1. A process for expanding a modular engine, the modular engine having a manifold assembly, the process comprising:

removing the manifold assembly from the modular engine, the modular engine comprising at least one engine bank and an existing shaft, each engine bank having a cam crank assembly, each cam crank assembly comprising a cam crank, an intake cam, an exhaust cam, and a securement assembly, and the intake cam and exhaust cam removably attached to the cam crank, the cam crank intermediate the intake cam and the exhaust cam;

loosening an existing cam crank assembly securement assembly from the existing shaft;

removing the existing shaft from the modular engine;

installing a longer shaft;

securing the existing cam crank assembly securement assembly on the longer shaft;

installing supplemental engine bank, having a supplemental cam crank assembly, on the longer shaft;

securing the supplemental engine bank to the longer shaft with the supplemental cam crank assembly; and replacing the manifold assembly.

2. The process of claim 1, further comprising:

each engine bank having an operational timing;

each cam crank assembly having a rotational position on the longer shaft;

setting the operational timing of the existing engine bank with the rotational position of the first cam crank assembly on the longer shaft;

setting the operational timing of the supplemental engine bank with the rotational position of the supplemental cam crank assembly on the longer shaft; and adjusting the radial angle between the rotational positions of the first cam crank assembly and the supplemental cam crank assembly to coordinate the operational timing of the exiting engine bank and the supplemental engine bank.

3. The process of claim 1, the modular engine having an existing ignition trigger assembly, further comprising:

removing existing ignition trigger assembly from the existing shaft before removing the manifold assembly; and installing a first ignition trigger assembly on the longer shaft after replacing the manifold assembly.

4. The process of claim 1, wherein:

the longer shaft comprises an external shaft and an internal shaft, the external shaft and the internal shaft coaxial and independently rotatable;

securing the longer shaft to the existing engine bank with a first cam crank assembly comprises securing the first cam crank assembly to the external shaft; and securing the supplemental engine bank to the longer shaft with the supplemental cam crank assembly comprises securing the supplemental cam crank assembly to the internal shaft.

5. The process of claim 1, the modular engine having an existing ignition trigger assembly, further comprising:

removing the existing ignition trigger assembly from the existing shaft before removing the manifold assembly;

the longer shaft comprises an external shaft and an internal shaft, the external shaft and the internal shaft coaxial and independently rotatable;

installing a first ignition trigger assembly on the external shaft after replacing the manifold assembly; and installing a second ignition trigger assembly on the internal shaft.

6. The process of claim 1, loosening an existing cam crank assembly securement assembly from the existing shaft further comprising:

loosening a plurality of bolts, each securement assembly comprising a plurality of tapered bushings functionally linked by the plurality of bolts, releasing an impingement of the tapered bushings between the shaft and the existing cam crank.

7. The process of claim 1, securing the supplemental engine bank to the longer shaft with the supplemental cam crank assembly securement assembly further comprising:

tightening a plurality of bolts, each securement assembly comprising a plurality of tapered bushings functionally linked by the plurality of bolts, creating an impingement of the tapered bushings between the shaft and the existing cam crank assembly.

8. A process for expanding a modular engine, the modular engine having a manifold assembly, the process comprising:

removing the manifold assembly from the modular engine, the modular engine comprising at least one engine bank and an existing shaft, each engine bank having a cam crank assembly and an exhaust channel, each cam crank assembly comprising a cam crank, an intake cam, an exhaust cam, and a securement assembly, the intake cam and exhaust cam removably attached to the cam crank, the cam crank intermediate the intake cam and the exhaust cam, the cam crank parallel to the intake cam and the exhaust cam, and the cam crank, the intake cam, and the exhaust cam oriented to be perpendicular to the shaft upon installation of the cam crank assembly on the shaft;

loosening an existing cam crank assembly securement assembly from the existing shaft;

removing the existing shaft from the modular engine;

installing a longer shaft;

securing the existing cam crank assembly securement assembly on the longer shaft;

installing supplemental engine bank, having a supplemental cam crank assembly, on the longer shaft such that the exhaust channel of the existing bank is incorporated into the exhaust channel of the supplemental channel;

securing the supplemental engine bank to the longer shaft with the supplemental cam crank assembly securement assembly; and replacing the manifold assembly.

9. The process of claim 8, loosening an existing cam crank assembly securement assembly from the existing shaft further comprising:

loosening a plurality of bolts, each securement assembly comprising a plurality of tapered bushings functionally linked by the plurality of bolts, a tapered bushing adjacent to each of the intake cam and exhaust cam on each bolt, releasing an impingement of the tapered bushings between the shaft and the existing cam crank assembly.

10. The process of claim 8, securing the supplemental engine bank to the longer shaft with the supplemental cam crank assembly securement assembly further comprising:

tightening a plurality of bolts, each securement assembly comprising a plurality of tapered bushings functionally linked by the plurality of bolts, a tapered bushing adjacent to each of the intake cam and exhaust cam on each bolt, creating an impingement of the tapered bushings between the shaft and the existing cam crank assembly.

11. The process of claim 8, further comprising:

each engine bank having an operational timing;

each cam crank assembly having a rotational position on the longer shaft;

setting the operational timing of the existing engine bank with the rotational position of the first cam crank assembly on the longer shaft;

setting the operational timing of the supplemental engine bank with the rotational position of the supplemental cam crank assembly on the longer shaft; and adjusting the radial angle between the rotational positions of the first cam crank assembly and the supplemental cam crank assembly to coordinate the operational timing of the exiting engine bank and the supplemental engine bank.

12. The process of claim 8, the modular engine having an existing ignition trigger assembly, further comprising:

removing existing ignition trigger assembly from the existing shaft before removing the manifold assembly; and installing a first ignition trigger assembly on the longer shaft after replacing the manifold assembly.

13. The process of claim 8, wherein:

the longer shaft comprises an external shaft and an internal shaft, the external shaft and the internal shaft coaxial and independently rotatable;

securing the longer shaft to the existing engine bank with a first cam crank assembly comprises securing the first cam crank assembly to the external shaft; and securing the supplemental engine bank to the longer shaft with the supplemental cam crank assembly comprises securing the supplemental cam crank assembly to the internal shaft.

14. The process of claim 8, the modular engine having an existing ignition trigger assembly, further comprising:

removing the existing ignition trigger assembly from the existing shaft before removing the manifold assembly;

the longer shaft comprises an external shaft and an internal shaft, the external shaft and the internal shaft coaxial and independently rotatable;

installing a first ignition trigger assembly on the external shaft after replacing the manifold assembly; and installing a second ignition trigger assembly on the internal shaft.

* * * * *